US007163773B2

(12) United States Patent
Sugiura et al.

(10) Patent No.: US 7,163,773 B2
(45) Date of Patent: Jan. 16, 2007

(54) TONER FOR DEVELOPING ELECTROSTATIC IMAGE, DEVELOPER, PROCESS FOR FORMING IMAGE, AND IMAGE FORMING APPARATUS

(75) Inventors: Hideki Sugiura, Shizuoka (JP); Satoshi Mochizuki, Shizuoka (JP); Yasuaki Iwamoto, Shizuoka (JP); Kazuhiko Umemura, Shizuoka (JP); Yasuo Asahina, Shizuoka (JP); Shinya Nakayama, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/644,938

(22) Filed: Aug. 21, 2003

(65) Prior Publication Data

US 2004/0115550 A1 Jun. 17, 2004

(30) Foreign Application Priority Data

Aug. 22, 2002 (JP) ..... 2002-241921
Jan. 22, 2003 (JP) ..... 2003-013349

(51) Int. Cl.
*G03G 9/087* (2006.01)

(52) U.S. Cl. ..... 430/109.4; 430/110.1; 430/110.2; 430/110.3; 430/110.4; 430/120

(58) Field of Classification Search ..... 430/110.3, 430/110.2, 110.1, 109.4, 120; 399/119, 252
See application file for complete search history.

(56) References Cited

U.S. PATENT DOCUMENTS

| | | | | |
|---|---|---|---|---|
| 5,547,802 | A * | 8/1996 | Kawase et al. | 430/108.24 |
| 5,624,779 | A | 4/1997 | Nakayama | |
| 5,753,399 | A * | 5/1998 | Hayase et al. | 430/109.3 |
| 5,797,070 | A * | 8/1998 | Waki et al. | 399/149 |
| 6,077,635 | A * | 6/2000 | Okado et al. | 430/45 |
| 6,080,519 | A * | 6/2000 | Ishiyama et al. | 430/110.3 |
| 6,468,706 | B1 | 10/2002 | Matsuda et al. | 430/108.6 |
| 6,503,676 | B1 | 1/2003 | Yamashita et al. | 430/108.3 |
| 6,544,704 | B1 | 4/2003 | Matsuda et al. | 430/108.6 |
| 6,593,048 | B1 | 7/2003 | Sasaki et al. | 430/106.1 |
| 6,630,276 | B1 | 10/2003 | Sugiura et al. | 430/108.3 |
| 6,653,037 | B1 | 11/2003 | Sawada et al. | 430/106.2 |
| 6,660,443 | B1 | 12/2003 | Sugiyama et al. | 430/108.4 |
| 2002/0006564 | A1 | 1/2002 | Kondou et al. | 430/45 |
| 2002/0081510 | A1* | 6/2002 | Sugiyama et al. | 430/108.1 |
| 2003/0104297 | A1* | 6/2003 | Matsuda et al. | 430/108.3 |
| 2003/0118366 | A1* | 6/2003 | Nukada et al. | 399/109 |
| 2003/0138717 | A1* | 7/2003 | Yagi et al. | 430/110.4 |

FOREIGN PATENT DOCUMENTS

EP 1 026 554 8/2000

OTHER PUBLICATIONS

U.S. Appl. No. 10/391,575, filed Mar. 20, 2003, Suzuki et al.
U.S. Appl. No. 10/318,109, filed Dec. 13, 2002, Sugiura et al.
U.S. Appl. No. 10/329,538, filed Dec. 27, 2002, Higuchi et al.
U.S. Appl. No. 10/212,736, filed Aug. 7, 2002, Sugiura et al.
U.S. Appl. No. 10/176,578, filed Jun. 24, 2002, Shimota et al.
U.S. Appl. No. 10/151,103, filed May 21, 2002, Kondo et al.
U.S. Appl. No. 10/444,013, filed May 23, 2003, Sawada et al.
U.S. Appl. No. 10/394,265, filed Mar. 24, 2003, Nanya et al.
U.S. Appl. No. 10/251,855, filed Sep. 23, 2002, Sawada et al.
U.S. Appl. No. 10/252,070, filed Sep. 23, 2002, Aoki et al.
U.S. Appl. No. 10/153,627, filed May 24, 2002, Suzuki et al.
U.S. Appl. No. 10/077,752, filed Feb. 20, 2002, Iwamoto et al.
U.S. Appl. No. 10/020,925, filed Dec. 19, 2001, Mochizuki et al.
U.S. Appl. No. 10/101,756, filed Mar. 21, 2002, Matsuda et al.
U.S. Appl. No. 10/077,813, filed Feb. 20, 2002, Matsuda et al.
U.S. Appl. No. 10/059,240, filed Jan. 31, 2002, Sugiura et al.
U.S. Appl. No. 10/284,177, filed Oct. 31, 2002, Yagi et al.
U.S. Appl. No. 10/158,069, filed May 31, 2002, Matsuda et al.
U.S. Appl. No. 10/086,415, filed Mar. 4, 2002, Sugiura et al.
U.S. Appl. No. 10/107,157, filed Mar. 28, 2002, Masuda et al.
U.S. Appl. No. 10/059,239, filed Jan. 31, 2002, Mochizuki et al.
U.S. Appl. No. 09/996,585, filed Nov. 30, 2001, Higuchi et al.
U.S. Appl. No. 10/086,683, filed Mar. 4, 2002, Matsuda et al.
U.S. Appl. No. 09/965,826, filed Oct. 1, 2001, Higuchi et al.
U.S. Appl. No. 09/905,872, filed Jul. 17, 2001, Sasaki et al.
U.S. Appl. No. 10/079,878, filed Feb. 22, 2002, Katoh et al.
U.S. Appl. No. 09/993,606, filed Nov. 27, 2001, Kotsuga et al.
U.S. Appl. No. 09/964,622, filed Sep. 28, 2001, Nanya et al.
U.S. Appl. No. 10/960,084, filed Oct. 8, 2004, Yamada et al.
U.S. Appl. No. 10/959,663, filed Oct. 7, 2004, Sugiura et al.
U.S. Appl. No. 11/081,738, filed Mar. 17, 2005, Nakayama et al.
U.S. Appl. No. 11/181,844, filed Jul. 15, 2005, Sugiura.
U.S. Appl. No. 11/185,803, filed Jul. 21, 2005, Sugiura et al.
U.S. Appl. No. 11/234,415, filed Sep. 26, 2005, Nakayama et al.
U.S. Appl. No. 11/227,566, filed Sep. 16, 2005, Nagatomo et al.

* cited by examiner

*Primary Examiner*—Janis L. Dote
(74) *Attorney, Agent, or Firm*—Oblon, Spivak, McClelland, Maier & Neustadt, P.C.

(57) ABSTRACT

Spherical toners having excellent fusibility are disclosed. The toners are fusible at low temperatures and are excellent in preservability and therefore charge properties, flowability, and transferability do not deteriorate. The toners contain a colorant and a nitrogen-containing polyester resin, in which the concentration of nitrogen at the surface of toner particles is higher than the concentration of nitrogen of the entire particles. The ratio of the surface concentration to the overall concentration is from 1.2 to 10. Additionally, the nitrogen-containing resin is preferably a polyester resin modified by urea bonds. Also, it is preferred that the toner particles are substantially spherical having an average sphericity E of from 0.90 to 0.99.

19 Claims, 6 Drawing Sheets

TONER FOR DEVELOPING ELECTROSTATIC IMAGE, DEVELOPER, PROCESS FOR FORMING IMAGE, AND IMAGE FORMING APPARATUS

BACKGROUND OF THE INVENTION

1. Field of the Invention

The present invention relates to a toner for developing an electrostatic image, a developer, a process for forming an image, and an image forming apparatus.

2. Description of the Related Art

In an electrophotographic device or electrostatic recording device, an electrostatic latent image is formed on a photoconductor, to which toner is attracted. The toner is transferred to a support material, such as a piece of paper, and then fused to the support material by heat and thus a toner image is formed. To form a full-color image, it is generally done by using four toners of different colors consisting of black, yellow, magenta, and cyan. Development is carried out for each color, each layer of toner is overlaid on the support material to form a toner image, and the image is then heated and simultaneously fused to obtain a full-color image.

In general, for a user who is accustomed to commercial prints such as offset lithographic prints, images created by full-color copiers are still not at a satisfactory level, and demands are high for further improving the quality to achieve the fineness and resolution that are comparable to those of photographic and offset prints. It is known that in order to improve the quality of an electrophotographic image, the diameters of toner particles should be small and the distribution of particle diameter should be narrow.

A latent image, either electric or magnetic, is made visible by toner. Toners used for developing an electrostatic image generally include colored particles comprising a colorant, a charge control agent, and other additives all with in a binder resin. Processes for manufacturing toner can be categorized broadly into pulverization (grinding) and polymerization.

Pulverization is a process in which a colorant, a charge control agent, an offset preventing agent, and the like are melted, mixed, and evenly dispersed in a thermoplastic resin, after which the mixture is crushed into small particles and classified to obtain the toner. With pulverization, toners having somewhat favorable properties can be manufactured, but materials that can be used for the toners are limited. For instance, a composition made by melting and mixing the components must be crushed and classified using an apparatus that is economically affordable. For this requirement, the composition should be sufficiently brittle.

Therefore, when the composition is actually crushed into particles, the distribution of particle diameters tends to be wide spread. The drawback is that the yield is extremely low when one tries to obtain a reproduced image having favorable tone and resolution because a portion of the toner particles, for example, minute particulates of 5 μm or less in diameter and large grains of 20 μm or more, must be removed by classification. In addition, it is difficult in pulverization to evenly disperse a colorant, a charge control agent, and the like within a thermoplastic resin. Uneven dispersion of the agents and additive adversely affect the flowability, developability, durability, image quality, and the like.

To overcome such problems in pulverization, toner particles are recently made by other processes such as suspension polymerization (Japanese Patent Application Laid-Open (JP-A) No. 09-43909). However, toner particles manufactured by suspension polymerization have a drawback of poor cleanability although they are spherical.

For development and transfer of low toner coverage image, there is little residual toner that is not transferred and therefore there is no concern of insufficient cleaning of toner. However, when the toner coverage of an image is high, e.g. a photographic image, a paper jam or the like may result in building up of non-transferred residual toner on a photoconductor on which toner is forming an image but not transferred. Accumulation of such residual toner leads to background shading. Moreover, residual toner contaminates components such as a charging roller, which charges a photoconductor by contact charging, and subsequently reduces the charging performance of the charging roller. Furthermore, concerns for toner particles formed by suspension polymerization include unsatisfactory fusibility at low temperatures and a large amount of energy required for fusion.

On the other hand, another process for manufacturing toner particles is disclosed in Japanese Patent (JP-B) No. 2537503 in which emulsion polymerization is used to form resin particulates, which are subsequently associated to obtain toner particles having irregular shapes. However, toner particles formed by emulsion polymerization have residual surfactants inside the particles as well as on the surface thereof, even after being washed by water, which reduces the environmental stability of toner charge, increases the distribution of the amount of charge, and causes background shading on a printed image. In addition, the residual surfactant contaminates photoconductor, charging roller, developing roller, and other components causing problems such as insufficient charging performance.

On the other hand, for the fusing process by contact heating, in which heating members such as a heating roller are used, the toner particles must possess releasability (which may be referred as offset resistance hereinafter) from the heating members. In such case, offset resistance can be improved by allowing a release agent to exist on the surface of the toner particles. In contrast, methods to improve offset resistance are disclosed in JP-A No. 2000-292973 and JP-A No. 2000-292978 in which resin particulates are not only contained in toner particles, but are concentrated at the surface of the toner particles. However, this approach brings up an issue in which the method increases the lowest possible temperature at which toner is fused and therefore is unsatisfactory in low temperature fusibility, i.e. energy-saving fusion.

In addition, this process, in which resin particulates obtained by emulsion polymerization are associated to provide irregular-shaped toner particles, has another problem. Generally, release agent particulates are additionally associated to improve the offset resistance. However, the release agent particulates are captured inside the toner particles and therefore the improvement of the offset resistance is not sufficient.

Moreover, since each toner particle is formed by a random adhesion of molten resin particulates, release agent particulates, colorant particulates, and the like, the composition (the ratio at which each component is contained), molecular weight of the resin, and the like may be different and dispersed for each obtained toner particle. In result, the surface properties of toner particles are different from one another, and it is impossible to form stable images for a long period.

Additionally, in a low-temperature fusing system, the resin particulates that are concentrated at the surface of the toner particles inhibit fusing and therefore the range of fusing temperature is not sufficient.

Recently, a new manufacturing process called emulsion-aggregation (EA) has been suggested (JP-B No. 3141783). In this process, particles are formed from polymers that are dissolved in an organic solvent or the like whereas in suspension polymerization, particles are formed from monomers, and it is said to be advantageous in that, for example, there is a larger selection of resins that can be used and polarity can be controlled. Furthermore, it is said to be advantageous in that it is possible to control the structure of toner particles (core/shell structure control). However, the shell structure is a layer consisting only of a resin and the purpose thereof is to lower the exposure of pigment and wax to the surface. The purpose is not to alter the structure in the resin, and the structure is not capable for such purpose (from The $4^{th}$ Joint Symposium of The Imaging Society of Japan and The Institute of Electrostatics Japan (Jul. 29, 2002)). Therefore, although the toner particle has a shell structure, the surface of the toner particle is a usual resin without any ingenious feature so that when the toner particle is targeted at fusing at a lower temperature, it is not satisfactory from the standpoint of anti-heat preservability and environmental charge stability and this is a concern.

In any of the above-mentioned processes, suspension polymerization, emulsion polymerization, and EA, styrene-acrylic resins are generally used. Polyester resins are difficult to be made into particles, and it is uneasy to control particle diameter, diameter distribution, and particle shape. Also, their fusibility is limited when the aim is to be fused at a lower temperature.

Polyester resins are, in contrast to styrene acrylic resins, has low viscosity and high elasticity and therefore has excellent low-temperature fusibility. If a reaction is possible in water, the control of molecular weight and the like become easy, and consequently, to form toner particles of small diameter and narrow size distribution become easy. However, the reaction temperature of polyester resin formation in industrial application is 200° C. or higher and it is therefore impossible for the reaction to take place in water.

In EA, a reaction can be conducted in water and a polyester resin is used, but the amount of resin that is initially put determines the final molecular weight and therefore it is difficult to control at the particle-forming step. In addition, there are problems such as decrease in reactivity due to high viscosity because high-molecular weight polyester is added in the initial step.

On the other hand, it is known that polyester modified by urea bonds is used for anti-heat preservability and low-temperature fusing (JP-A No. 11-133667). However, it is not possible to change the composition depthwise only by using the polyester, and the environmental charge stability is not satisfactory especially when the conditions are harsh.

For conventional methods of pulverization, it is difficult to adjust so that for each toner particle, the hardness of the surface and that of the center because particles are pulverized after they are melted and mulled.

Conventional polymerization processes include, for example, suspension polymerization disclosed in JP-A No. 09-43909 and the like, emulsion polymerization disclosed in JP-B No. 2537503 and the like, EA disclosed in JP-B No. 3141783 and the like, and use of polyester modified by urea bonds disclosed in JP-A No. 11-133667 and the like. These conventional polymerization methods cannot make toner particles having different hardness between the surface and the center.

EA is a process in which toner particles are formed from polymers that are dissolved in an organic solvent or the like whereas in suspension polymerization, toner particles are made from monomers, and it is said to be advantageous in that, for example, there is a larger selection of resins that can be used and polarity can be controlled. Furthermore, it is said to be advantageous in that it is possible to control the structure of toner particles (core/shell structure control). However, the core/shell structure as mentioned here aims to lower the exposure of pigment and wax at the surface, and the core is a layer that contains wax and pigment while the shell is a layer that contains does not contain pigment and wax. With such configuration, the distribution of pigment and wax is different in the core and shell, but the distribution has no relationship with the hardness of the toner particle and there is no change of structure with in the resin. Additionally, the toner particles of such configuration have effective releasability, but still have issues to overcome the wide range of problems of the related arts.

Referring to core/shell toner particles, JP-A Nos. 11-305487 and 2002-229251, for example, disclose core/shell toner particles that include resin in both core and shell in which the resin in the shell has a higher glass transition temperature. JP-A No. 05-197193 discloses a core/shell toner particle containing wax therein. In the core/shell toner particle, an interface inhibits the permeation of the wax. In addition, the existence of the interface reduces color reproducibility and thermal conductivity during fusing.

Much work has been done from various angles of approach in the field of electrophotography to improve quality, and it is being recognized that it is extremely effective to reduce the size and increase the sphericity of the toner particle. However, as the diameter of toner particles becomes smaller, the transferability and fusibility tend to decrease, and image quality becomes poor. On the other hand, it is known that by making toner particles round, the transferability rises (JP-A No. 09-258474).

In such situation, ever-faster image production is desired in the field of color copiers and printers. For a faster printing, the "tandem method" is effective (as disclosed, for example, in JP-A No. 05-341617). The "tandem method" is a method in which images formed by respective image forming units are sequentially transferred and overlaid on a sheet of paper that is advanced by a transfer belt so that a full-color image is obtained on the sheet.

A color image forming apparatus using tandem method is characteristic in that various kinds of paper can be used, the quality of full-color images are high, and full-color images can be formed at high speed. The high-speed output of full-color images is especially characteristic and no other color image reproduction machines have that characteristic.

There are other attempts to increase speed while improving the quality by using round toner particles. However, while toner particles must be quickly fused in order to accommodate for high-speed output, no round toner particle that has a good fusibility as well as low-temperature fusibility has been realized to date.

In addition, after the manufacture of a toner, environments during storage and transport, such as hot and humid, or low and dry, are severe for the toner. There are demands for a toner having excellent preservability where toner particles do not coagulate even after being stored in such environments and deterioration of is none or very little for charge characteristics, flowability, transferability, and fusibility. However, no effective way has been found to date, especially for spherical toner particles, that enables to overcome such issues.

SUMMARY OF THE INVENTION

It is therefore an object of the present invention to provide a toner, a developer, an image forming apparatus, and a process for forming an image that enable stable image formation even after an output of tens of thousands of images. Specifically, objects of the present invention are the following paragraphs (1) to (5).

(1) To provide a toner, a developer, an image forming apparatus, and a process for forming an image whose cleanability is maintained, that comply with low-temperature fusing systems, whose offset resistance is favorable, and that do not contaminate a fusing apparatus and an image.

(2) To provide a toner, a developer, an image forming apparatus, and a process for forming an image in which the number of less charged and oppositely charged is small, whose distribution of charged amounts is narrow, and that can form visualized images having high sharpness for a long period of time.

(3) To provide a toner, a developer, an image forming apparatus, and a process for forming an image whose environmental preservability (in hot and humid, or cold and dry environment) is excellent.

(4) To provide an image forming apparatus and a process for forming an image that form images with little background shading (fog) having excellent charge stability in hot and humid or cold and dry environment, and in which toner does not spread out inside a machine.

(5) To provide an image forming apparatus and a process for forming an image that are both highly durable and highly maintainable as an image forming system.

The inventors of the present invention have discussed intensively to resolve the issues and found out that for a toner containing a resin and a colorant, using an electrostatic image developing toner characterized in that the surface thereof is harder than the center thereof, the surface thereof is more heat resistant than the center thereof, or the surface thereof has a higher density of cross-links than the center thereof, can provide a toner, a developer, an image forming apparatus, and a process for forming an image whose cleanability is maintained, that comply with low-temperature fusing systems, whose offset resistance is favorable, that do not contaminate a fusing apparatus and an image, and whose distribution of charged amounts is good even in hot and humid or cold and dry environment.

The toners on the present invention, toners characterized in that the surface thereof is harder than the center thereof, the surface thereof is more heat resistant than the center thereof, or the surface thereof has a higher density of cross-links than the center thereof, are, for example, of a structure in which the hardness, heat resistance, or cross-link density of the toner increases as the distance from the center increase, i.e. along an axis from the center to the surface. It is therefore different from the structure of core/shell toners that have a two-layer structure.

It is of note that a case in which different resins are used is included in the scope of the present invention.

Toners characterized in that the surface thereof is harder than the center thereof, the surface thereof is more heat resistant than the center thereof, or the surface thereof has a higher density of cross-links than the center thereof includes, for example, a toner having a higher ratio of nitrogen in the surface of the toner particle than the ratio of nitrogen in the entire toner.

As an example of an indicator of the hardness of a toner surface, the relative amount of nitrogen existing in the surface of toner particles is compared with the relative amount of nitrogen in the entire toner. However, it is understood that the measurement of the hardness is not limited to this method. The method will be described in detail hereinafter.

The following processes can be used to obtain a toner of the present invention:

(1) A process in which conditions are controlled after toner particles are formed to obtain a toner characterized in that the surface thereof is harder than the center thereof, the surface thereof is more heat resistant than the center thereof, or the surface thereof has a higher density of cross-links than the center thereof.

(2) A process in which conditions are controlled during the formation of toner particles to obtain a toner characterized in that the surface thereof is harder than the center thereof, the surface thereof is more heat resistant than the center thereof, or the surface thereof has a higher density of cross-links than the center thereof.

An example for the process (1) is dissolving the surface by an acid or alkali after the particle formation, and examples for the process (2) include regulating the rate of reaction and using a special reaction initiator.

The rate of reaction can be regulated by, for example, choosing a solvent, or by controlling temperature, pH, and the share at the time of the reaction.

As an example for the mechanism, a case for using a so-called "modified" polyester resin that contains nitrogen will be described hereinafter.

Although its mechanism is yet to be fully understood, the following presumption is made according to some analyzed data. By using a modified polyester resin that contains nitrogen, it is possible to allow the resin to be harder and have a molecular structure that is thermally and physically more stable than a typical polyester resin. However, such resin having a high hardness can be a fusing inhibiting factor and is not desirable. Therefore, it is presumed that the nitrogen-containing polyester structure, whose hardness is high, exists more at the surface of a toner particle, thereby providing the toner with offset resistance, chargeability, cleanability, and environmental preservability, while a softer polyester resin resides mainly at the center to provide fusibility, resulting in achieving not only the coexistence of offset resistance and low-temperature fusibility but also environmental charge stability. It has also been found out that the structure does not have to be a shell structure, and that it is effective when the concentration of nitrogen is higher at the surface than the entire toner.

Moreover, it has been discovered that the above-mentioned effect can be enhanced by using a toner for electrostatic image containing the nitrogen-containing polyester resin in which the ratio (S/V) of the amount of nitrogen at the surface (S) to the amount of nitrogen in the entire toner (V) is from 1.2 to 10, more preferably from 1.5 to 5. When the ratio S/V is less than 1.2, the hardness of the surface is too low and offset resistance is not satisfactory. When the ratio is more than 10, the hardness of the surface is so high that low-temperature fusibility is not sufficient.

Furthermore, when the polyester resin containing nitrogen is a polyester resin modified by urea bonds, the effect is further enhanced and therefore is more preferable. In addition, it is further preferable that the toner includes particles that are formed by elongation and/or cross-linking reactions in which toner materials including prepolymers are dissolved in oil droplets of an organic solvent that are dispersed in an aqueous solvent. The reason is that by precisely controlling the conditions for elongation reaction, conditions for maturation, or the like, the degree of uneven concentration of nitrogen can be controlled.

When the toner for developing an electrostatic image contains toner particles that are substantially spherical having an average sphericity E of from 0.90 to 0.99, the asperity of the toner surface can be controlled and the dispersion of nitrogen atoms to the toner surface can be regulated more easily. Also, it is preferred because dust-free, high quality images of high transferability can be obtained.

When the toner for developing an electrostatic image contains toner particles having sphericity SF-1 (which will be described hereinafter) of from 100 to 140 and sphericity SF-2 (described hereinafter) of from 100 to 130, since the asperity of the toner surface is controlled by SF-2 and the overall shape of the toner particle is controlled by SF-1, the dispersion of nitrogen atoms to the toner surface is controlled more easily and therefore it is preferable. Also, it is preferred because dust-free, high quality images of high transferability can be obtained.

Moreover, using a two component developer that contains the toner and carrier particles comprising magnetic particles compensates for the insufficient charge stability of nitrogen-containing polyesters and provides sufficiently narrow distribution of charge amounts, and therefore it is preferable.

Thus, the present invention provides a toner for developing an electrostatic image comprising toner particles of a polyester resin and a colorant wherein a concentration of nitrogen is higher at a surface of the toner particles than a concentration of nitrogen at a center of the toner particles.

The present invention also provides a two component developer comprising a toner of the present invention and carrier particles containing magnetic particles.

The present invention further provides an image forming apparatus comprising a developer of the present invention.

The present invention additionally provides a process for forming an image comprising developing an electrostatic image by a developer of the present invention.

The present invention also provides means for containing a toner of the present invention.

The present invention further provides a process cartridge comprising a toner of the present invention.

DESCRIPTION OF THE PREFERRED EMBODIMENTS

Figure 1:
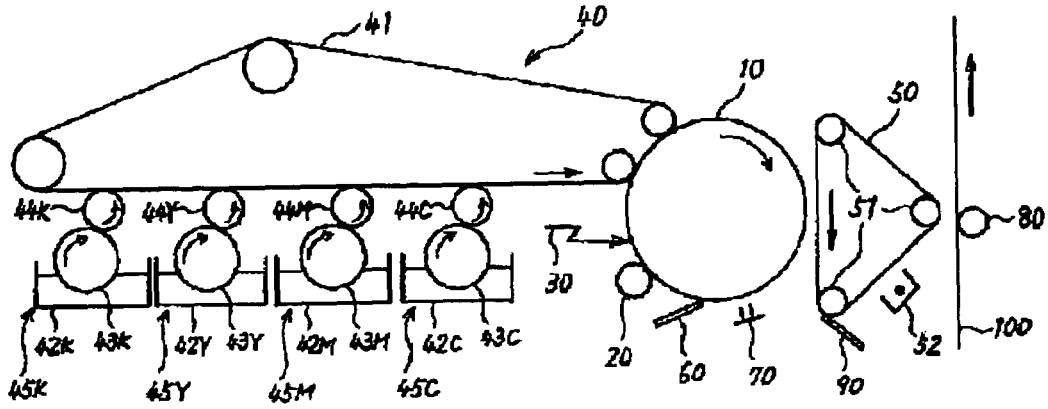
FIG. 1 is a schematic view of an example of an image forming apparatus that is used for a process for forming an image of the present invention.

The present invention will be described in detail hereinafter. It is to be understood that any well known manufacturing process, material, system, and the like can be used for a toner, developer, and electrophotographic process of the present invention if conditions are met.

(Overall Concentration of Nitrogen)

A concentration of nitrogen in an entire toner can be measured, for example, by the following method.

A concentration of nitrogen in an entire toner is measured by CHN elemental analysis using a Yanaco CHN Corder MT-5. If required, a measurement is carried out after a resin is extracted from the toner.

A sample of from 1 mg to 2 mg is combusted in a gas flow of helium (carrier gas) that includes a certain amount of oxygen. The combusted gas passes through the layers of copper oxide, Sulfix, silver, and reduced copper, and becomes a gas mixture from which excess oxygen, sulfur, and halogen are removed and which consists mostly of helium and contains $H_2O$, $CO_2$, and $N_2$. A certain volume of the gas mixture is collected in a mixing tube, kept at a constant temperature, and then introduced into a detector at a constant rate. The detector consists of three pairs of differential thermal conductivity cells that are connected in series, which are connected, respectively, to an $H_2O$ absorbing tube, a $CO_2$ absorbing tube, and a delay coil. As the gas mixture passes through each pair, $H_2O$, $CO_2$, and $N_2$ are sequentially removed from the mixture, which result in a difference of thermal conductivity at the inlet and the outlet. The difference is measured as a signal of voltage corresponding to the concentration of each component and thus the concentration of nitrogen can be quantified.

(Surface Concentration of Nitrogen)

A concentration of nitrogen at the surface of toner particles can be measured, for example, by the following method. Throughout this specification, "at the surface" means a portion of toner particles from the surface to a depth at which the concentration of nitrogen can be measured and analyzed by X-ray photoelectron spectroscopy (XPS). Specifically, the analyzed portion is confined to the very surface of toner particles, which is from the surface to about several nanometers deep.

XPS measurement can be conducted under the following conditions and using the following apparatus.

Apparatus: PHI 1600S X-ray photoelectron spectrometry (Physical Electronics USA)

X-ray source: Mg K-alpha (400 W)

Analyzing region: 0.8 mm by 2.0 mm

Preparation: A sample is spread over the entire surface of an aluminum dish and attached to a sample holder by a carbon sheet. According to a calculation using the area of the analyzing region, the system can measure an average surface concentration of nitrogen of about 50,000 toner particles.

Calculation of surface concentration of atoms: The relative sensitivity factors provided by Physical Electronics USA are used for the calculation.

Since an obtained result is in atomic percent (percent by the number of atoms), a conversion is carried out to obtain a value in percent by weight. The conversion formula is as follows:

weight %=amount of nitrogen (atomic %)×atomic weight of nitrogen (14.01)/Σ(amount of each detected element (atomic %)×atomic weight of each element)

(S/V Ratio)

Unevenness of the concentration of nitrogen can be discussed by using the S/V ratio represented by the following formula:

*S/V* ratio=surface concentration of nitrogen (*S*; % by weight)/overall concentration of nitrogen (*V*; % by weight)

(Surface Strength)

The surface strength of a toner can be estimated from the relation between compression strength and displacement (caused by toner deformation) using a micro-compression testing machine or the like.

It can also be calculated from a force curve of an atomic force microscope, or the like.

(Average Sphericity E)

It is important for a toner of the present invention to have a specific shape and certain distribution of shapes, and it is preferred that the average sphericity E is from 0.90 to 0.99. If the sphericity of a toner is less than 0.90 and the shape thereof is far from a sphere and irregular, sufficient transferability and dust-free high quality images cannot be obtained. If the sphericity of a toner is more than 0.99, the toner particles are perfect spheres, and cleanability is adversely affected. Therefore, it is not preferable. To measure the shape of toner particles, it is suitable to use the optical detection method in which a suspension of the particles is passed through an image detection unit on a plate, and a CCD camera optically captures an image of particles to analyze the particles.

By using the method, a projected area of a toner particle can be measured. The average sphericity E is calculated by dividing the perimeter of a circle (circumference) having the same projected area as an actual toner particle with the perimeter of the toner particle. More preferably, the average sphericity E of a toner is from 0.94 to 0.99, so that the toner can form properly reproduced, fine images of appropriate density. With regards to easiness of cleaning, it is more suitable if the average sphericity E is from 0.94 to 0.99 and not more than 10% of all the particles have the sphericity less than 0.94.

An average sphericity E can be measured by using a flow particle image analyzer FPIA-1000 (To a Medical Electronics). Specifically describing the measurement process, first, to a container filled with from 100 ml to 150 ml of water from which solid impurities are removed beforehand, a surfactant, preferably from 0.1 ml to 0.5 ml of alkylbenzenesulfonate, is added as a dispersant, and from 0.1 g to 0.5 g of testing sample is further added. Using a supersonic dispersing device, the suspension in which the sample is dispersed is treated for about 1 to 3 minutes to allow the particle concentration to be from 3,000 particles/μl to 10,000 particles/μl. Then, the analyzer is used to measure the shape and the distribution of the toner sample to obtain the average sphericity E.

(Sphericity SF-1 and SF-2)

Shape coefficients SF-1 and SF-2 are sphericity factors for the present invention, which are measured as follows. An S-4200 field emission scanning electron microscope (Hitachi Ltd.) is used to obtain SEM images of toner particles. Then, 300 images are randomly selected, and the information of the images is introduced to a LUZEX AP image analyzer (Nireco Corporation) through an interface and analyzed by the device. Then, using the following formulae, SF-1 and SF-2 are defined. It is preferred that SF-1 and SF-2 are measured using a LUZEX analyzer, but as far as the same analysis can be made, devices being used are not limited to the above-mentioned FESEM and image analyzer.

$$SF\text{-}1=(L^2/A)\times(\Pi/4)\times100$$

$$SF\text{-}2=(P^2/A)\times(\Pi/4)\times100$$

where "L" is the absolute maximum length of a toner particle, "A" is the projected area of a toner, and "P" is the maximum perimeter of a toner.

For a sphere, both values are 100, and as the values increase, a shape is deformed from a sphere to an irregular shape. Specifically, SF-1 is a shape coefficient that reflects the overall shape of a toner (whether it is more like an ellipsoid or a sphere) and SF-2 is another shape coefficient that reflects the degree of asperity on the surface.

(Mean diameter ratio Dv/Dn (ratio of volume mean diameter to number mean diameter))

It is preferable that the volume mean diameter (Dv) of toner particles of the present invention is from 2 μm to 7 μm and the ratio of the volume mean diameter to the number mean diameter (Dn), Dv/Dn, is equal to or less than 1.25, more preferably between 1.10 and 1.25 inclusive. If the ratio is in the preferred range, the dry toner is excellent in all of anti-heat preservability, low-temperature fusibility, and hot offset resistance. In addition, when used in a full-color copier, images have excellent gloss. Moreover, in a two component developer, the fluctuation of toner particle diameter in the developer is reduced even after consumption and replenishment of toner is carried out for a long period of time, and good and stable development is achieved after a long term agitation by a developing device. In this specification, a device, unit, or apparatus which develops a latent image may be referred in such words as image-developer, developing apparatus, developing device, or the like.

In addition, when used as a single component developer, the fluctuation of toner particle diameter is reduced even if consumption and replenishment of toner is conducted, and there is no filming of toner to developing roller and no adhesion of molten toner to members such as a blade for making a thin layer of toner. Furthermore, good and stable development is achieved and quality images are obtained even after a long term use (agitation) of a developing device.

It is said that generally, the smaller that diameter of toner particles is, the more advantageous it is to obtain high resolution and high quality images. However, it is, on the contrary, disadvantageous with regards to transferability and cleanability. Moreover, if the volume mean diameter is less than the preferred range of the present invention, in a two component developer, molten toner particles adhere to the surface of carrier particles after a long term agitation in an image-developer device, degrading the charge performance of the carrier particles. When used as a single component developer, filming of toner to developing roller and adhesion of molten toner to members such as a blade for making a thin layer of toner are more likely to occur.

These phenomena are also observed for a toner that has higher ratio of small toner particles therein than the preferred range of the present invention (i.e. Dv/Dn>1.25).

On the other hand, if the diameter of toner particles is larger than the preferred range of the present invention, it becomes difficult to obtain high resolution and high quality images, and in many cases the fluctuation of toner particle diameters is larger when the toner in a developer is consumed and replenished. In addition, it has been discovered that the same applies for a case when the ratio Dv/Dn is larger than 1.25.

(Nitrogen-containing Polyester Resin)

For a toner of the present invention, modified polyester resins as described hereinafter can be used as the nitrogen-containing resin. For example, it is possible to use polyester prepolymers having one or more isocyanate groups. Such isocyanate group-containing polyester prepolymers (A) can be made, for example, from a polyester that is a polycondensation product of a polyol (1) and a polycarboxylic acid (2) and that contains one or more active hydrogen-containing group, which is then reacted with a polyisocyanate (3). The active hydrogen-containing group includes a hydroxyl group (an alcoholic hydroxyl group and phenolic hydroxyl group), amino group, carboxylic group, mercapto group, and the like, among which an alcoholic hydroxyl group is preferred.

Polyols (1) include diol (1-1) and polyols having three or more hydroxyl groups (1-2), and it is preferable to use (1-1) alone, or a mixture of (1-1) and a small amount of (1-2).

Diols (1-1) include alkylene glycols (ethylene glyco, 1,2-propylene glycol, 1,3-propylene glycol, 1,4-butane diol, 1,6-hexane diol, and the like); alkylene ether glycols (diethylene glycol, triethylene glycol, dipropylene glycol, polyethylene glycol, polypropylene glycol polytetramethylene ether glycol, and the like); alicyclic diols (1,4-cyclohexane dimethanol, hydrogenated bisphenol A, and the like); bisphenols (bisphenol A, bisphenol F, bisphenol S, and the like); adducts of alicyclic diols with alkylene oxides (ethylene oxide, propylene oxide, butylene oxide, and the like); adducts of bisphenols with alkylene oxides (ethylene oxide, propylene oxide, butylene oxide, and the like); and the like. Among these, alkylene glycols having 2 to 12 carbon atoms and adducts of bisphenols with alkylene oxides are preferred, and particularly preferred are adducts of bisphenols with alkylene oxides and a mixture thereof with alkylene glycols having 2 to 12 carbon atoms.

Polyols having three or more hydroxyl groups (1-2) include polyhydric aliphatic alcohols having 3 to 8 hydroxyl groups (glycerin, trimethylolethane, trimethylolpropane, pentaerythritol, sorbitol, and the like); polyhydric phenols having 3 or more hydroxyl groups (trisphenol PA, phenol novolac, cresol novolac, and the like); adducts of polyhydric phenols having 3 or more hydroxyl groups with alkylene oxides; and the like.

Polycarboxylic acids (2) include dicarboxylic acids (2-1), polycarboxylic acids having 3 or more hydroxyl groups (2-2), and the like, and it is preferable to use (2-1) alone, or a mixture of (2-1) and a small amount of (2-2). Dicarboxylic acids (2-1) include alkylene dicarboxylic acids (succinic acid, adipic acid, sebacic acid, and the like); alkenylene dicarboxylic acids (maleic acid, fumaric acid, and the like); aromatic dicarboxylic acids (phthalic acid, isophthalic acid, terephthalic acid, naphthalene dicarboxylic acid, and the like); and the like.

Among these, alkenylene dicarboxylic acids having 4 to 20 carbon atoms and aromatic dicarboxylic acids having 8 to 20 carbon atoms are preferable. Polycarboxylic acids having 3 or more hydroxyl groups (2-2) include aromatic polycarboxylic acids having 9 to 20 carbon atoms (trimellitic acid, pyromellitic acid, and the like) and the like. It is of note that polycarboxylic acids (2) may be replaced with an acid anhydride or a lower alkyl ester (methyl ester, ethyl ester, isopropyl ester, or the like) of the above-described carboxylic acids to be reacted with polyols (1).

The ratio of a polyol (1) to a polycarboxylic acid (2), by the equivalent ratio of hydroxyl groups (OH) to carboxyl groups (COOH), which is [OH]/[COOH], is typically 2/1 to 1/1, preferably 1.5/1 to 1/1, more preferably 1.3/1 to 1.02/1.

Polyisocyanates (3) include aliphatic polyisocyanates (tetramethylene diisocyanate, hexamethylene diisocyanate, 2,6-diisocyanate methylcaproate, and the like); alicyclic polyisocyanates (isophorone diisocyanate, cyclohexylmethane diisocyanate, and the like); aromatic diisocyanates (tolylene diisocyanate, diphenylmethane diisocyanate, and the like); aromatic aliphatic diisocyanates ($\alpha,\alpha,\alpha',\alpha'$-tetramethylxylene diisocyanate and the like); isocyanurates; above-mentioned polyisocyanates blocked with a phenol derivative, an oxime, caprolactum, or the like; and combinations of two or more of these.

The ratio of a polyisocyanate (3), by the equivalent ratio of isocyanate groups (NCO) to hydroxyl groups (OH) of the polyester, [NCO]/[OH], is typically 5/1 to 1/1, preferably 4/1 to 1.2/1, more preferably 2.5/1 to 1.5/1. When the ratio [NCO]/[OH] is more than 5, low-temperature fusibility is degraded. When the molar ratio of [NCO] is less that 1, the amount of urea in the modified polyester is low and thus adversely affect hot offset resistance. The amount of polyisocyanate (3) component in an isocyanate group-containing prepolymer (A) is typically 0.5% by weight to 40% by weight, preferably 1% by weight to 30% by weight, more preferably 2% by weight to 20% by weight. If the amount is less than 0.5% by weight, hot offset resistance is lowered and it is disadvantageous with regards to satisfying anti-heat preservability and low-temperature fusibility at the same time. If the amount is more than 40% by weight, low-temperature fusibility is reduced.

The number of isocyanate groups contained for each molecule of isocyanate group-containing prepolymer (A) is typically 1 or more, preferably 1.5 to 3 in average, more preferably 1.8 to 2.5 in average. If it is less than 1 per molecule, the molecular weight of the modified polyester after cross-linking and/or elongation is reduced and therefore hot offset resistance is degraded.

(Cross-linking Agent and Elongation Agent)

Amines can be used as a cross-linking agent and/or elongation agent for the present invention. Amines (B) include diamines (B1), polyamines having 3 or more amino groups (B2), amino alcohols (B3), amino mercaptans (B4), amino acids (B5), derivatives of B1 to B5 in which the amino groups are blocked (B6), and the like.

Diamines (B1) include aromatic diamines (phenylene diamine, diethyltoluene diamine, 4,4'-diaminodiphenylmethane, and the like); alicyclic diamines (4,4'-diamino-3,3'-dimethyldicyclohexylmethane, diaminocyclohexane, isophoronediamine, and the like); aliphatic diamines (ethylenediamine, tetramethylenediamine, hexamethylenediamine, and the like); and the like.

Polyamines having 3 or more amino groups (B2) include diethylenetriamine, triethylenetetramine, and the like. Amino alcohols (B3) include ethanolamine, hydroxyethylaniline, and the like. Amino mercaptans (B4) include aminoethyl mercaptan, aminopropyl mercaptan, and the like.

Amino acids (B5) include amino propionic acid, amino caproic acid, and the like. Derivatives of B1 to B5 in which the amino groups are blocked (B6) include ketimine compounds and oxazoline compounds that are obtained from amines of B1 to B5 and ketones (acetone, methylethylketone, methylisobutylketone, and the like), and other compounds. Among these amines (B), B1 and a mixture of B1 and a small amount of B2 are preferable.

Additionally, an inhibitor can be used for cross-linking and elongation, if needed, to adjust the molecular weight of the modified polyester after the reaction. Inhibitors include monoamines (diethylamine, dibutylamine, butylamine, laurylamine, and the like), those that are blocked (ketimine compounds), and the like.

The ratio of amines (B) by the equivalent ratio of isocyanate groups (NCO) in the isocyanate group-containing prepolymer (A) to amino groups (NHx) in the amine (B), [NCO]/[NHx], is typically 1/2 to 2/1, preferably 1.5/1 to 1/1.5, more preferably 1.2/1 to 1/1.2. If the ratio [NCO]/[NHx] is more than 2 or less than 1/2, the molecular weight of the modified polyester will be low and its hot offset resistance will be degraded.

(Unmodified Polyester)

For the present invention, the modified polyester (A) can be used alone, but an important use is to use unmodified polyester (C) included as a toner binder component in addition to (A). By using (C) with (A), low-temperature fusibility and the gloss of images when used in a full-color device are improved. Examples of (C) include the same polyester components of (A), which are condensation polymerization products of polyols (1) and polycarboxylic acids (2), and preferred examples are also the same as those of (A). In addition to an unmodified polyester, (C) can also be a polyester modified by a chemical bond other than a urea bond, for example, a urethane bond.

It is preferable from the standpoint of low-temperature fusibility and hot offset resistance that (A) and (C) form a mixture that is compatible at least in a portion thereof. Therefore, it is preferred that the polyester component of (A) and (C) have similar compositions. In the mixture, the weight ratio of (A) to (C) is typically 5/95 to 75/25, preferably 10/90 to 25/75, more preferably 12/88 to 25/75, and particularly preferably 12/88 to 22/78. When the weight ratio of (A) is less than 5%, hot offset resistance is degraded, and it is disadvantageous with regards to satisfying anti-heat preservability and low-temperature fusibility at the same time.

The peak molecular weight of (C) is typically from 1,000 to 30,000, preferably from 1,500 to 10,000, more preferably from 2,000 to 8,000. When it is lower than 1,000, its anti-heat preservability is degraded, and when it is higher than 30,000, low-temperature fusibility is degraded. The hydroxyl value of (C) is preferably 5 or more, more preferably 10 to 120, and particularly preferably 20 to 80. When the hydroxyl value is less than 5, it is disadvantageous with regards to satisfying anti-heat preservability and low-temperature fusibility at the same time. The acid value of (C) is typically 0.5 to 40, preferably 5 to 35. By allowing (C) to have a preferred acid value, it is more likely that (C) becomes negatively chargeable. If either the acid value or hydroxyl value of a compound of (C) is not in the preferred range, it is subject to environmental effects in hot and humid or cold and dry environments, and therefore is likely to result in poor quality images.

The glass transition points (Tg) of the toners of the present invention are typically from 40° C. to 70° C., preferably 45° C. to 55° C. When it is lower than 40° C., the anti-heat preservability is degraded, and when it is higher than 70° C., the low-temperature fusibility becomes insufficient. Due to the coexistence of the polyester resin that is cross-linked and/or elongated, the toners of the present invention for developing an electrostatic image exhibit better preservability even if their glass transition points are low, compared with well known polyester toners.

Regarding the storage elasticity modulus of a toner, the temperature (TG') at which the storage elasticity modulus is 10,000 dyne/cm$^2$ at a measured frequency of 20 Hz, is typically 100° C. or higher, preferably 110° C. to 200° C. When it is lower than 100° C., hot offset resistance is degraded. Regarding the viscosity of a toner, the temperature (Tη) at which the viscosity is 1,000 poises at a measured frequency of 20 Hz, is typically 180° C. or lower, preferably 90° C. to 160° C. When it is higher than 180° C., low-temperature fusibility is degraded.

Therefore, from the viewpoint of obtaining both low-temperature fusibility and hot offset resistance at the same time, TG' is preferably higher than Tη. In other words, the difference of TG' and Tη is preferably 0° C. or more. It is more preferably 10° C. or more, and is particularly preferably 20° C. or more. There is no particular limitation as to the upper limit of the difference. From the viewpoint of obtaining both anti-heat preservability and low-temperature fusibility at the same time, the difference of Tη and Tg is preferably 0° C. to 100° C., more preferably 10° C. to 90° C. and particularly preferably 20° C. to 80° C.

(Colorant)

For a colorant of the present invention, any dye or pigment well known in the art can be used. Examples of the colorant include carbon black, nigrosine dye, iron black, naphthol yellow S, Hanza yellow (10G, 5G, G), cadmium yellow, yellow iron oxide, ocher, chrome yellow, titanium yellow, polyazo yellow, oil yellow, Hanza yellow (GR, A, RN, R), pigment yellow L, benzidine yellow (G, GR), permanent yellow (NCG), Balkan fast yellow (5G, R), tartrazine lake, quinoline yellow lake, anthracene yellow BGL, isoindolinone yellow, red iron oxide, minium, lead vermilion, cadmium red, cadmium mercury red, antimony vermilion, Permanent-Red 4R, Para Red, Fire Red, p-chloro-o-nitroaniline red, risol fast scarlet, brilliant fast scarlet, Brilliant Carmine BS, permanent red (F2R, F4R, FRL, FRLL, F4RH), fast scarlet VD, Vulcan Fast Rubine B, brilliant scarlet G, Lithol Rubine GX, permanent-Red F5R, brilliant carmine 6B, Pigment Scarlet 3B, Bordeaux 5B, Toluidine Maroon, Permanent Bordeaux F2K, Helio Bordeaux BL, bold 10B, BON Maroon Light, BON Maroon Medium, eosine lake, rhodamine lake B, rhodamine lake Y, alizarin lake, Thioindigo Red B, Thioindigo Maroon, oil red, quinacridone red, pyrazolone red, polyazo red, chrome vermilion, benzidine orange, Perynone Orange, oil orange, cobalt blue, cerulean blue, alkali blue lake, peacock blue lake, Victoria blue lake, non-metallic phthalocyanine blue, phthalocyanine-blue, fast sky blue, Indanthrene Blue (RS, BC), indigo, ultramarine blue, Berlin blue, anthraquinone blue, fast violet B, methyl violet lake, cobalt purple, manganese purple, dioxane violet, anthraquinone violet, chrome green, zinc green, chrom oxide, viridian, emerald green, pigment green B, naphthol green B, green gold, acid green lake, malachite-green lake, phthalocyanine green, anthraquinone green, titanium oxide, zinc white, lithopone, and mixtures thereof, and the like. The content of the colorant is typically 1% by weight to 15% by weight, and is preferably 3% by weight to 10% by weight, relative to the toner.

A colorant of the present invention can be combined with a resin and used as a masterbatch. For the manufacture of a masterbatch, various materials can be used as a binder resin that is kneaded with a colorant in addition to the modified and unmodified polyesters mentioned above, for example, polymers of styrene or substituted styrenes such as polystyrene, poly p-chlorostyrene, polyvinyl toluene, and the like; styrene copolymers such as styrene-p-chlorostyrene copolymer, styrene-propylene copolymer, styrene-vinyltoluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloromethyl methacrylate copolymer, styrene-acrylonitrile copolymer, styrene-vinylmethylketone copolymer, styrene-butadiene copolymer, styrene-isoprene copolymer, styrene-acrylonitrile-indene copolymer, styrene-maleic acid copolymer, styrene-maleate copolymers, and the like; polymethylmethacrylate, polybutylmethacrylate, polyvinyl chloride, polyvinyl acetate, polyethylene, polypropylene, polyester, epoxy resins, epoxy polyol resins, polyurethanes, polyamides, polyvinyl butyral, polyacrylic resins, rosin, modified rosin, terpene resin, aliphatic or alicyclic hydrocarbon resins, aromatic petroleum resins, chlorinated paraffin, paraffin wax, and the like. These may be used either alone or in combination of two or more.

The masterbatch can be obtained by mixing and kneading a resin for masterbatch and a colorant with a high shear force. In order to enhance the interaction between the colorant and the resin, an organic solvent may be used. Also, the so-called flushing method may be used in which an aqueous paste of a colorant that contains water is mixed and kneaded together with a resin and an organic solvent, thereby transferring the colorant to the resin, and the water and organic solvent components are removed thereafter. This method is preferred because a wet cake of the colorant can be used directly and there is no need for drying. For the mixing and kneading, a high shear dispersing machine such as a three roller mill, or the like is preferably used.

Wax may be included in addition to a toner binder and colorant. The wax may be any of those known in the art. Examples of the wax include polyolefin waxes (polyethylene wax, polypropylene wax, and the like); long chain hydrocarbons (paraffin wax, Sasol wax, and the like); carbonyl group-containing waxes, and the like. Of these, the carbonyl group-containing waxes are preferred. Examples of the carbonyl group-containing waxes include polyalkane acid esters (carnauba wax, montan wax, trimethylolpropane tribehenate, pentaerythritol tetrabehenate, pentaerythritol diacetate dibehenate, glyceryl tribehenate, 1,18-octadecanediol distearate, and the like); polyalkenol esters (trimellitic acid tristearyl, distearyl maleate, and the like); polyalkane acid amides (ethylenediamine dibehenylamide, and the like); polyalkylamides (trimellitic tristearylamides, and the like); dialkyl ketones (distearylketone, and the like), and the like. Of the carbonyl group-containing waxes, the polyalkane acid esters are preferred.

The melting point of the wax used in the present invention is typically 40° C. to 160° C., preferably 50° C. to 120° C., and more preferably 60° C. to 90° C. If the melting point of the wax is less than 40° C., there is an adverse effect on anti-heat preservability. If the melting point of the wax is more than 160° C., cold offset during fusing tends to occur at low temperature. Further, the melt viscosity of the wax at a temperature 20° C. higher than the melting point is preferably 5 cps to 1,000 cps, more preferably 10 cps to 100 cps. If the melt viscosity of the wax is more than 1,000 cps, there is not much improvement of hot offset resistance and low-temperature fusibility. The content of the wax in the toner is typically 0% by weight to 40% by weight, preferably 3% by weight to 30% by weight.

(Charge Control Agent)

A toner of the present invention may further contain a charge control agent if needed. Any of the charge control substances known in the art may be used. Examples of the charge control agent include negrosine dyes, triphenylmethane dyes, chrome-containing metal complex dyes, molybdic acid chelate dyes, rhodamine dyes, alkoxy amines, quaternary ammonium salts (including fluorinated quaternary ammonium salts), alkyl amides, phosphorus and its compounds, tungsten and its compounds, fluorine activating agents, metal salicilates, metal salts of salicylic acid derivatives, and the like.

Specific examples are BONTRON 03 as the negrosine dye, BONTRON P-51 as the quaternary ammonium salt, BONTRON S-34 as the alloy metal azo dye, oxynaphthoic acid metal complex E-82, the salicylic acid metal complex E-84, the phenolic condensate E-89 (available from Orient Chemical Industries), the quaternary ammonium salt molybdenum complexes TP-302, TP-415 (available from Hodogaya Chemical Industries), the quaternary ammonium salt COPY CHARGE PSY VP2038, the triphenylmethane derivative COPY BLUE PR, the quaternary ammonium salts COPY CHARGE NEG VP2036 and COPY CHARGE NX VP434 (available from Hoechst), LRA-901, LR-147 as the boron complex (available from Japan Carlit Co., Ltd.), copper phthalocyanine, perylene, quinacridone, azo pigments, and other polymer compounds containing a functional groups such as sulfonic acid group, carboxyl group, quaternary ammonium salt, and the like.

The amount of the charge control agent in the present invention is determined according to the type of the binder resin, the presence or absence of additives that are used if necessary, and the process for manufacturing the toner including the dispersion method, and therefore there is no universal limitation. However, the amount of the charge control substance is preferably 0.1 parts by weight to 10 parts by weight relative to 100 parts by weight of the binder resin, more preferably 0.2 parts by weight to 5 parts by weight. If it is more than 10 parts by weight, the chargeability of the toner is excessively large, the effect of the main charge control agent is diminished, the electrostatic attraction with the developing roller increases, and result in a deterioration in flowability of the developer and decrease of image density. These charge control agent may be melt kneaded together with the master batch and resin and then dissolved and/or dispersed, may naturally be added upon dissolution or dispersion in an organic solvent, or may be fixed on the surface of toner particles after the particles are formed.

(Resin Particulates)

Resin particulates may be included in a toner of the present invention if needed. The resin particles that are used preferably have a glass transition point (Tg) of from 40° C. to 100° C. and a weight average molecular weight of from 9,000 to 200,000. As mentioned earlier, if the glass transition point (Tg) is lower than 40° C. and/or the weight average molecular weight is less than 9,000, the preservability of the toner is degraded and therefore a blocking can occur during storage or in a developing device. If the glass transition point (Tg) is higher than 100° C. and/or the weight average molecular weight is more than 200,000, the resin particulates inhibit adhesiveness to a sheet of paper to which the toner is fused and therefore the lowest fusible temperature will be higher.

The residual rate to toner particles is preferably 0.5% by weight to 5.0% by weight. If the residual rate is less than 0.5% by weight, the preservability of the toner is degraded and therefore a blocking can occur during storage or in a developing device. If the residual rate is more than 5.0% by weight, the resin particulates inhibit wax to seep out and reduce the releaseability effect of the wax, and consequently may cause offset. The residual rate of the resin particulates can be measured by an analysis in which a pyrolysis gas chromatograph mass spectrometer is used to analyze a substance derived only from the resin particulates and not from the toner particles and calculate the peak area thereof. For the detector, a mass spectrometer is preferable, but it is not limited.

The resin particulates can be made of any resin, thermoplastic or thermosetting, as long as they are capable of forming an aqueous dispersion. Examples thereof include vinyl resins, polyurethane resins, epoxy resins, polyester resins, polyamide resins, polyimide resins, silicone resins, phenol resins, melamine resins, urea resins, aniline resins, ionomer resins, polycarbonate resins, and the like. Two or more of these resins may be used in combination for the resin particulates. Among these, from the standpoint of the capability to obtain an aqueous dispersion of the spherical resin particulates, vinyl resins, polyurethane resins, epoxy resins, polyester resins, and combinations thereof are preferable.

Vinyl resins include polymers and copolymers of vinyl monomers such as styrene-(meth)acrylate resin, styrene-butadiene copolymer, (meth)acrylate-acrylate polymer, styrene-acrylonitrile copolymer, styrene-maleic acid anhydride copolymer, styrene-(meth)acrylate copolymer, and the like.

(Auxiliary Additive)

Inorganic particulates can preferably be used an auxiliary additive that complements flowability, developability, and chargeability of the colored particles of the present invention. The primary particle diameter of the inorganic particulates is preferably 5 nm to 2 μm, more preferably 5 nm to 500 nm. The specific surface area measured by the BET method is preferably 20 $m^2/g$ to 500 $m^2/g$. The amount of the inorganic particulates in a toner is preferably 0.01% by weight to 5% by weight of the toner, more preferably 0.01% by weight to 2.0% by weight.

Specific examples of the inorganic particulates include silica, alumina, titanium oxide, barium titanate, magnesium titanate, calcium titanate, strontium titanate, zinc oxide, tin oxide, silica sand, clay, mica, silicic pyroclastic rock, diatomite, chromium oxide, cerium oxide, red iron oxide, antimony trioxide, magnesium oxide, zirconium oxide, barium sulfate, barium carbonate, calcium carbonate, silicon carbide, silicon nitride, and the like.

In addition, the examples include polymer particulates obtained by, for example, soap-free emulsion polymerization, suspension polymerization, or dispersion polymerization, such as polystyrene, methacrylate, and acrylate copolymers, and the like; condensation polymers such as silicone, benzoguanamine, nylon, or the like; polymer particles of thermosetting resins; and the like.

These flowability enhancers (inorganic particulates) can be surface-treated to increase hydrophobicity so that they can prevent loss of flowability and chargeability even under high humidity. Examples of suitable surface treatment agents include silane coupling agents, silylating agents, silane coupling agents having a fluorinated alkyl group, organic titanate coupling agents, aluminum coupling agents, silicone oil, modified silicone oil, and the like.

A cleanability improving agent that help remove the developer remaining on a photoconductor or a primary transfer medium after transfer can be added to a toner. Examples of the cleaneability improving agent include fatty acid metal salts such as zinc stearate, calcium stearate, stearic acid, and the like; polymer particulates manufactured by soap-free emulsion polymerization or the like such as polymethylmethacrylate particulates, polystyrene particulates; and the like. The polymer particulates preferably have a relatively narrow particle size distribution, and a volume mean particle diameter of 0.01 μm to 1 μm.

(Process for Manufacturing Toner)

[Process for Manufacturing Toner Binder]

The toner binder may be, for example, manufactured by the following process.

A polyol (1) and polycarboxylic acid (2) are heated to 150° C. to 280° C. in the presence of an esterification catalyst known in the art such as a tetrabutoxy titanate, dibutyl tin oxide, or the like. Next, the water produced in the reaction is distilled off under reduced pressure if necessary, and a polyester that contains hydroxyl groups is thereby obtained. Thereafter, the polyisocyanate (3) is reacted with the polyester at 40° C. to 140° C. so as to obtain the prepolymer (A) that contains isocyanate groups.

[Process for Manufacturing Toner in Aqueous Phase]

A dry toner of the present invention may be manufactured by the following process, being understood that it naturally does not limit the process for manufacturing.

The aqueous phase used in the present invention is used after the resin particulates are added. The aqueous phase may be water alone, or water mixed with a miscible solvent. Examples of such miscible solvents include alcohols (methanol, isopropanol, ethylene glycol, and the like), dimethylformamide, tetrahydrofuran, cellusolves (methyl cellusolve, and the like.), lower ketones (acetone, methyl ethyl ketone, and the like).

The toner particles may be formed by reacting a dispersion of an organic solvent in which a prepolymer (A) having isocyanate groups is dissolved or dispersed with amines (B) in the aqueous phase. One of the processes for stably forming the dispersion of the organic solvent comprising the prepolymer (A) in an aqueous phase, is to add all toner materials including the prepolymer (A) to the aqueous phase, and disperse it by shear force. The prepolymer (A) and other toner components (hereafter, referred to as toner materials) such as a colorant, colorant masterbatch, release agent, charge control agent, unmodified polyester resin, and the like may be added when the dispersion is formed in the aqueous phase, but it is preferable to first mix the toner materials together, and then dissolve or disperse this mixture in the organic solvent, and thereafter disperse the organic solvent in the aqueous phase.

Further, for the present invention, it is not absolutely necessary to mix other toner materials such as a colorant, release agent, charge control agent, and the like, when the particles are formed in the aqueous phase, and they may be added after the particles have been formed. For example, after forming particles that do not contain a colorant, a colorant can be added by a dyeing method known in the art.

There is no particular limitation on the dispersion method which may employ any dispersion apparatus known in the art such as low speed shear, high speed shear, friction, high-pressure jet, ultrasound, or the like. To obtain dispersed particles having a diameter of 2 μm to 20 μm, the high speed shear is preferred. When a high speed shear dispersion apparatus is used, there is no particular limitation on the rotation speed, but is typically 1,000 rpm to 30,000 rpm, and is preferably 5,000 rpm to 20,000 rpm. There is no particular limitation on the dispersion time, but in the case of a batch process, this is typically 0.1 minute to 5 minutes. The temperature at which a dispersion is prepared is typically 0°

C. to 150° C. (under pressure), preferably 40° C. to 98° C. If a higher temperature is used, the viscosity of the organic solvent comprising the prepolymer (A) is lower, and dispersing is easier, which is desirable.

The amount of the aqueous phase relative to 100 parts by weight of the toner composition comprising the prepolymer (A) is typically 50 parts by weight to 2,000 parts by weight, and is preferably 100 parts by weight to 1,000 parts by weight. If it is less than 50 parts by weight, the dispersion state of the toner composition is poor, and particles having the predetermined particle diameter are not obtained. If it is more than 2,000 parts by weight, it is not economical. A dispersion agent can also be added if necessary. The use of a dispersion agent makes the particle distribution narrow and stabilizes the dispersion, and is therefore preferable.

Examples of dispersion agents which can be used to emulsify and disperse the oil phase in which the toner composition is dispersed, in an aqueous phase, are anionic surfactants such as alkyl benzene sulfonates, α-olefin sulfonates, phosphoric acid esters, or the like; amine salts such as alkylamine salts, aminoalcohol fatty acid derivatives, polyamine fatty acid derivatives, imidazoline, or the like; quaternary ammonium salt cationic surfactants such as alkyltrimethyl ammonium salts, dialkydrimethyl ammonium salts, alkyl dimethyl benzyl ammonium salts, pyridinium salts, alkyl isoquinolinium salts, benzetonium chloride, or the like; non-ionic surfactants such as fatty acid amide derivatives, polyvalent alcohol derivatives, or the like; amphoteric surfactants such as aniline, dodecyldi(aminoethyl)glycine, di(octylaminoethyl)glycine, N-alkyl-N,N-dimethylammoniumbetaine, or the like; and the like.

By using a surfactant having a fluoroalkyl group, an effect can be obtained with an extremely small amount of the surfactant. Examples of anionic surfactants having a fluoroalkyl group which can be conveniently used are fluoroalkyl carboxylic acids having 2 to 10 carbon atoms and metal salts thereof, disodium perfluorooctane sulfonylglutamate, sodium 3-[omega-fluoroalkyl (C6 to C11) oxy]-1-alkyl (C3 to C4) sulfonate, sodium 3-[omega-fluoroalkanoyl (C6 to C8)-N-ethylamino]-1-propane sulfonate, fluoroalkyl (C11 to C20) carboxylic acids and metal salts thereof, perfluoroalkyl carboxylic acids (C7 to C13) and metal salts thereof, perfluoroalkyl (C4 to C12) sulfonates and metal salts thereof, perfluorooctanesulfonic acid diethanolamide, N-propyl-N-(2-hydroxyethyl) perfluorooctane sulfonamide, perfluoroalkyl (C6 to C10) sulfonamide propyltrimethylammonium salt, perfluoroalkyl (C6 to C10)-N-ethylsulfonyl glycine salt, monoperfluoroalkyl (C6 to C16) ethyl phosphoric acid ester, and the like.

Examples of the commercial products are SURFLON S-111, SURFLON S-112, SURFLON S-113 (available from Asahi Glass Co., Ltd.), FLUORAD FC-93, FLUORAD FC-95, FLUORAD FC-98, FLUORAD FC-129 (available from Sumitomo 3M, Co., Ltd.), UNIDYNE DS-101, DS-102 (available from Daikin Industries, Ltd.), MEGAFACE F-110, MEGAFACE F-120, MEGAFACE F-113, MEGAFACE F-191, MEGAFACE F-812, MEGAFACE F-833 (available from Dainippon Ink and Chemicals Incorporated), EFTOP EF-102, EF-103, EF-104, EF-105, EF-112, EF-123A, EF-123B, EF-306A, EF-501, EF-201, EF-204 (available from JEMCO Inc.), FTERGENT F-100, FTERGENT F-150 (available from NEOS), and the like.

Examples of cationic surfactants are primary, secondary or tertiary amines having a fluoroalkyl group, quaternary ammonium salts of fatty acids such as perfluoroalkyl ($C^6$ to $C^{10}$) sulfonamide propyltrimethylammonium salt, or the like; benzalkonium salts, benzetonium chloride, pyridinium chloride and imidazolinium salts, examples of commercial products being SURFLON S-121 (available from Asahi Glass Co., Ltd.), FLUORAD FC-135 (available from Sumitomo 3M). UNIDYNE DS-202 (available from Daikin Industries, Ltd.), MEGAFACE F-150, MEGAFACE F-824 (available from Dainippon Ink and Chemicals Incorporated), EFTOP EF-132 (available from JEMCO Inc.), FTERGENT F-300 (available from NEOS), and the like.

Inorganic compound dispersing agents insoluble in water such as tricalcium phosphate, calcium carbonate, titanium oxide, colloidal silica, hydroxyapatite, or the like can also be used.

The dispersion droplets may also be stabilized by a polymer protecting colloid. Examples are acids such as acrylic acid, methacrylic acid, α-cyanoacrylic acid, α-cyanomethacrylic acid, itaconic acid, crotonic acid, fumaric acid, maleic acid, maleic anhydride, or the like; (meth) acrylic monomers which contain hydroxyl groups such as β-hydroxyethyl acrylic acid, β-hydroxyethyl methacrylic acid, β-hydroxypropyl acrylic acid, β-hydroxypropyl methacrylic acid, γ-hydroxypropyl acrylic acid, γ-hydroxypropyl methacrylic acid, 3-chloro-2-hydroxypropyl methacrylic acid, diethylene glycol monoacrylic acid ester, diethylene glycol monomethacrylic acid ester, glycerine monoacrylic acid ester, glycerine monomethacrylic acid ester, N-methyloylacrylamide, N-methyloylmethacrylamide, or the like; vinyl alcohol or ether of vinyl alcohol such as vinyl methyl ether, vinyl ethyl ether and vinyl propyl ether, esters of compounds containing a carboxylic group with vinyl alcohol such as vinyl acetate, vinyl propionate and vinyl butyrate, acrylamide, methacrylamide, diacetone acrylamide, methyloyl compounds thereof, or the like; acid chlorides such as acrylic acid chloride and methacrylic acid chloride, homopolymers and copolymers containing a nitrogen atom or its heterocyclic ring such as vinyl pyridine, vinyl pyrrolidine, vinyl imidazole, ethyleneimine, or the like; polyoxyethylene compounds such as polyoxthylene, polyoxypropylene, polyoxyethylene alkylamine, polyoxyethylene propylamine, polyoxyethylene alkylamide, polyoxypropylene alkylamide, polyoxyethylene nonyl phenyl ether, polyoxyethylene lauryl phenyl ether, polyoxyethylene stearyl phenyl ether, polyoxyethylene nonyl phenyl ester, or the like; celluloses such as methyl cellulose, hydoxyethyl cellulose, hydroxypropyl cellulose, or the like; and the like.

If a substance such as calcium phosphate which is soluble in acid or alkali is used as a dispersion stabilizer, the calcium phosphate or other substance is dissolved using acid such as hydrochloric acid, or the like, and calcium phosphate is then removed from the particles by rinsing with water. It may also be removed by enzymatic decomposition.

If a dispersant is used, the dispersant may be left on the surface of the toner. From the viewpoint of charging toner, it is preferred to remove it by washing after elongation and/or cross-linking reaction.

Reaction time for the elongation and/or cross-linking is selected according to the reactivity of the combination of the isocyanate group in the prepolymer (A) and the amine (B), and it is typically 10 minutes to 40 hours, and is preferably 2 hours to 24 hours. The reaction temperature is typically 0° C. to 150° C., and is preferably 40° C. to 98° C. A catalyst known in the art may also be used if required. Specific examples are dibutyl tin laurate, dioctyl tin laurate, and the like.

In order to allow nitrogen concentration to be higher at the surface than the entire toner particle, it is preferable to allow the reaction to mature after the reactants are mixed and the solvent is removed in addition to adjusting the reaction time and temperature for elongation and/or cross-linking to the above-mentioned preferred ranges. The temperature for maturing is 30° C. to 80° C., preferably 35° C. to 55° C., and the time for maturing is 1 hour to 24 hours, preferably 2 hours to 10 hours. The nitrogen ratio of surface concentration (S) to overall concentration (V), S/V, can be changed by controlling the reaction conditions, solvent removing conditions, and maturing conditions. It is preferred to adjust the conditions to be within the above-mentioned range in order to control the S/V ratio within a range of from 1.2 to 10.

To remove the organic solvent from the obtained emulsified dispersion, the temperature of the whole system is gradually raised, and the organic solvent in the liquid droplets is completely removed by evaporation. Alternatively, the emulsified dispersion is sprayed into a dry atmosphere to completely remove the water-insoluble organic solvent in the liquid droplets and form toner particles, and aqueous dispersing agent is removed at the same time by evaporation. The dry atmosphere into which the emulsified dispersion is sprayed, is generally a heated gas such as air, nitrogen, carbon dioxide or combustion gas, the gas flow being heated to a temperature above the boiling point of the highest-boiling point solvent being used. The desired product quality can be obtained in a short time by using a spray dryer, belt dryer, rotary kiln, or the like.

If the particle size distribution during emulsification dispersion is large, and washing or drying are performed while maintaining this particle size distribution, the particle size distribution can be adjusted to a desired particle size distribution by classification. The classification is performed by removing particles from the liquid using a cyclone, decanter, centrifugal separation, or the like. The classifying can naturally be performed after obtaining the dry powder. It is preferred from the viewpoint of efficiency to perform this in the liquid. The unnecessary toner particles, either too small or too large, can be recycled to the melt-kneading step to form new toner particles. In that case, the unnecessary toner particles may be wet. It is preferred that the dispersing agent is removed from the obtained dispersion as much as possible, and this is preferably done at the same time as the classifying described above.

The obtained powder of the toners after drying may be mixed with other particles such as release agent, charge control agent, flowability enhancer, colorant particulates, and the like, and a mechanical impact may be given to the mixed powder so that the particles are fixed or fused on the surface to each other, which prevents separation of the particles from the surface of the obtained complex particles.

Specific methods for doing this include giving an impact to the mixture by high speed rotating blades, introducing the mixture into a high-speed gas flow to be accelerated so that the particles collide with each other or the complex particles are made to strike a suitable impact plate, and the like. The device used for this purpose may be an Angmill (available from Hosokawa Micron Corporation) or I-mill (available from Japan Pneumatic) that is modified to reduce the air pressure upon pulverizing, a Hybridization system (available from Nara Machine Laboratories), a Kryptron system (available from Kawasaki Heavy Industries), an automatic mortar, or the like.

It is possible to use other manufacturing processes such as polymerization process, capsule process, and the like. These processes are described briefly hereinafter.

<Polymerization Process 1>

(1) Monomers are put into an aqueous dispersion medium, and, if needed, polymerization initiator, colorant, wax, and the like are added. Thereafter particles are formed.
(2) The formed particles of monomer composition are classified by particle diameters into a suitable range.
(3) The classified particles of monomer composition having suitable diameters are polymerized.
(4) After a dispersant is removed by a suitable treatment, the obtained polymerization product is filtered, washed by water, and dried to obtain base particles.

<Polymerization Process 2>

(1) A low molecular weight resin, high molecular weight resin, colorant, wax, wax dispersant, and optional components of charge control agent or the like are dispersed in an oil phase dispersion medium of a solution such as ethyl acetate or the like.
(2) Then the dispersion is added dropwise to water that contains organic particulates and an elongation agent and allow it to be emulsified and constringe.
(3) The dispersion is heated, thereby polymerized and the solvent is removed.
(4) After maturing in the water, it is washed, collected and dried and thus base particles are obtained.

<Capsule Process>

(1) A resin and optional colorant or the like are kneaded by a kneading machine or the like, to obtain toner cores that are fused.
(2) The toner cores are put in water and stirred intensively to make cores of particulates.
(3) The core particulates are added in a shell material solution. A bad solvent is added dropwise while stirring, and the cores are capsulated by being covered by the shell material.
(4) The obtained capsules are filtered and dried to obtain base particles.

In any of the above processes, by setting optimum maturing conditions for each process (maturing time, maturing temperature, maturing environment, and the like), it is possible to conduct milder reaction, and therefore nitrogen concentration can be made higher at the surface than that of the entire toner.

(Two Component Carrier)

If the toner of the present invention is used in a two component developer, it may be used in combination with a magnetic carrier, and the blending ratio of the carrier and the toner in the developer is preferably 1 part by weight to 10 parts by weight of the toner, relative to 100 parts by weight of the carrier. The magnetic carrier may be any of those known in the art. Examples of the magnetic carrier include iron powder, ferrite powder, magnetite powder, a magnetic resin carrier, or the like, each of which having a particle diameter of approximately 20 μm 200 μm.

For coating materials, examples include amino resins such as urea-formaldehyde resin, melamine resin, benzoguanamine resin, urea resin, polyamide resin, epoxy resin, and the like. Other examples are polyvinyl and polyvinylidene resins such as acrylic resins, polymethyl methacrylate resin, polyacrylonitrile resin, polyvinyl acetate resin, polyvinyl alcohol resin, polyvinyl butyral resin, polystyrene resins such as styrene-acryl copolymer resin, halogenated olefin resins such as polyvinyl chloride, polyester resins such as polyethylene terephthalate resin and polybutylene terephthalate resin, polycarbonate resins, polyethylene resins, polyvinyl fluoride resin, polyvinylidene fluoride resin, polytrifluoro ethylene resin, polyhexafluoropropylene resin, copolymers of vinylidene fluoride with acrylic monomers, copolymers of vinylidene fluoride with vinyl fluoride, fluoroterpolymers such as the terpolymer of tetrafluoroethylene, vinylidene fluoride and a non-fluoride monomer, silicone resins, and the like. An electroconducting powder or the like may also be contained in the coating material if necessary.

Examples of electroconducting powders are metal powders, carbon black, titanium oxide, tin oxide, zinc oxide, and the like. These electroconducting powders preferably have an average particle diameter of 1 μm or less. If the average particle diameter is more than 1 μm, it is difficult to control electrical resistance.

The toner of the present invention may also be used as a single-component magnetic toner that does not use a carrier. The toner of the present invention may also be used as a non-magnetic toner.

(Intermediate Transfer Body)

An intermediate transfer body can be used for the present invention. An embodiment of the intermediate transfer body of a transfer system will be described. FIG. 1 is a view of a schematic configuration of a copier of the embodiment. Around a photoconductor drum (hereinafter referred to as photoconductor) 10 as an image substrate, a charging roller 20 as a charging device, an exposing device 30, a cleaning device 60 having a cleaning blade, a diselectrifying lamp 70 as a device to remove charge, a developing device 40, and an intermediate transfer body 50 are arranged. The intermediate transfer body 50 is configured so that it is suspended by a plurality of suspension rollers 51, and moves in the direction of the arrow by driving means such as a motor (not shown) in a manner of an endless belt.

One or more of the suspension rollers 51 has an additional role as a transfer bias roller, which supplies a transfer bias to the intermediate transfer body, and a power supply (not shown) applies a desired transfer bias voltage thereto. Additionally, a cleaning device 90 having a cleaning blade for the intermediate transfer body 50 is also arranged. Further, a transfer roller 80 is positioned facing the intermediate transfer body 50 as transfer means to transfer a developed image to a sheet of support paper 100, which is the final support material. A power source (not shown) supplies a transfer bias voltage to the transfer roller 80. Moreover, a corona charger 52 as a charging device is located by the intermediate transfer body 50.

The developing device 40 comprises a developing belt 41 as a developer support, a black (hereinafter Bk) developing unit 45K, yellow (hereinafter Y) developing unit 45Y, magenta (hereinafter M) developing unit 45M, and cyan (hereinafter C) developing unit 45C, the developing units positioned around the developing belt 41. In addition, the developing belt 41 is configured so that it is suspended by a plurality of belt rollers, and by driving means such as a motor or the like (not shown), is advanced to the direction of the arrow in a manner of an endless belt. The developing belt 41 moves at substantially the same speed as the photoconductor 10 at a section where the two contact each other.

Since the configurations of the developing units are common, only the Bk developing unit 45K will be described, and for other developing units 45Y, 45M, and 45C, components that correspond to those in the Bk developing unit 45K are shown in the figure with the same reference numbers followed by a letter Y, M, and C, respectively, and their descriptions are omitted. The developing unit 45K comprises a developing tank 42K that contains a solution of developer of high viscosity and high density including toner particles and carrier liquid component, a scooping roller 43K that is positioned so that its lower portion is dipped in the liquid developer in the developing tank 42K, and a applying roller 44K that receives the developer scooped by the scooping roller 43K, makes a thin layer of the developer, and applies the developer to the developing belt 41. The applying roller 44K is electrically conductive, and a power source (not shown) applies a desired bias thereto.

Figure 2:
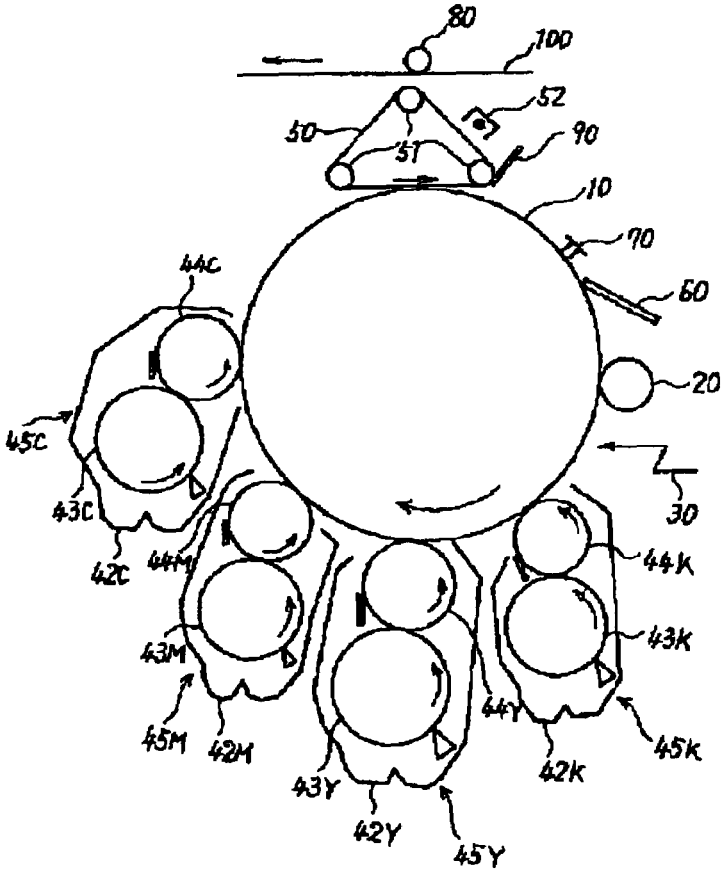
FIG. 2 is a schematic view of an example of an image forming apparatus having a configuration in which image-developer units of different colors are arranged around a photoconductor.

With regards to the device configuration of the copier of this embodiment, a device configuration different from the one shown in FIG. 1 may be employed in which a developing unit of each color is located around a photoconductor 10, as shown in FIG. 2.

Next, the operation of the copier of the embodiment will be described. In FIG. 1, the photoconductor 10 is rotationally driven in the direction of the arrow and is uniformly charged by the charging roller 20. Then, the exposing device 30 uses reflected light from the original document passing through an optical system (not shown) and forms an electrostatic latent image on the photoconductor 10. The electrostatic latent image is then developed by the developing device 40, and a toner image as a visualized (developed) image is formed. A thin layer of developer on the developing belt 41 is released from the belt 41 in a form of a thin layer by a contact with the photoconductor in a developing region, and is moved to the portion where the latent image is formed on the photoconductor 10. The toner image developed by the developing device 40 is transferred to the surface of the intermediate transfer body 50 at a portion of contact (primary transfer region) of the photoconductor 10 and the intermediate transfer body 50 that is moving at the same speed (primary transfer). In a case when three colors or four colors are transferred and overlaid, the process is repeated for each color to form a color image on the intermediate transfer body 50.

The corona charger 52 is placed in order to charge the overlaid toner image on the intermediate transfer body at a position that is downstream of the contact section of the photoconductor 10 and the intermediate transfer body 50, and that is upstream of the contact section of the intermediate transfer body 50 and the sheet of support paper 100 with regards to the direction of the rotation of the intermediate transfer body 50. Then, the corona charger 52 provides a charge to the toner image the polarity of which is the same as that of the toner particles that form the toner image, and gives a sufficient charge for a good transfer to the sheet of support paper 100. After being charged by the corona charger 52, the toner image is transferred at once to the sheet of support paper 100 that is carried in the direction of the arrow from a sheet feeder (not shown) by a transfer bias of the transfer roller 80 (secondary transfer). Thereafter, the sheet of support paper 100 to which the toner image is transferred is detached from the photoconductor 10 by a detaching device (not shown), and fusing is conducted thereto by a fusing device (not shown). After that, the sheet 100 is ejected from the device. On the other hand, after the transfer, the cleaning device 60 removes and retrieves toner particles that are not transferred from the photoconductor 10, and the diselectrifying lamp 70 removes remaining charge from the photoconductor 10 to prepare for the next charging.

The static friction coefficient of the intermediate transfer body is preferably 0.1 to 0.6, more preferably 0.3 to 0.5. The volume resistance of the intermediate transfer body is preferably several Ω cm or more and $10^3$ Ω cm or less. By controlling the volume resistance from several Ω cm to $10^3$ Ω cm, charging of the intermediate transfer body itself is prevented. It also prevents uneven transfer at secondary transfer because the charge that is provided by charging means does not remain as much. In addition, it is easier to apply transfer bias for the secondary transfer.

The materials for the intermediate transfer body in not particularly limited, and all materials known to the art can be used. Examples are named hereinafter.

(1) Materials with high Young's moduli (tension elasticity) used as a single layer belt, which includes polycarbonates (PC), polyvinylidene fluoride (PVDF), polyalkylene terephthalate (PAT), blend materials of PC/PAT, ethylene tetrafluoroethylene copolymer (ETFE)/PC, and ETFE/PAT, thermosetting polyimides of carbon black dispersion, and the like. These single layer belts having high Young's moduli are small in their deformation against stress during image formation and are particularly advantageous in that mis-registration is not easily formed when forming a color image.

(2) A double or triple layer belt using the above-described belt having high Young's modulus as a base layer, added with a surface layer and an optional intermediate layer around the peripheral side of the base layer. The double or triple layer belt has a capability to prevent print defect of unclear center portion in a line image that is caused by the hardness of the single layer belt.

(3) A belt with a relatively low Young's modulus that incorporates a rubber or an elastomer. This belt has an advantage that there is almost no print defect of unclear center portion in a line image due to its softness. Additionally, by making the width of the belt wider than driving and tension rollers and thereby using the elasticity of the edge portions that extend over the rollers, it can prevent snaky move of the belt. Therefore, it can reduce cost without the need for ribs and a device to prevent the snaky move.

Conventionally, intermediate transfer belts have been adopting fluorine resins, polycarbonates, polyimides, and the like, but in the recent years, elastic belts in which elastic members are used in all layers or a part thereof. There are issues on transfer of color images using a resin belt.

Color images are typically formed by four colors of color toners. In one color image, toner layers of layer 1 to layer 4 are formed. Toner layers are pressurized as they pass the primary transfer (in which the layers are transferred from the photoconductor to the intermediate transfer belt) and the secondary transfer (in which the toner is transferred from the intermediate transfer belt to the sheet), which increases the cohesive force among toner particles. As the cohesive force increases, phenomena such as drop outs of letters and dropouts of edges of solid images are likely to occur. Since resin belts are too hard to be deformed by the toner layers, they tend to compress the toner layers and therefore drop out phenomena of letters are likely to occur.

Recently, the demand for printing full color images on various types of paper such as Japanese paper and paper having a rough surface is increasing. However, with sheets of paper having low smoothness, gaps between the toner and the sheet are likely to be formed at transfer and therefore mis-transfers can happen. In the transfer pressure of secondary transfer section is raised in order to increase contact, the cohesive force of the toner layers will be higher, which will result in drop out of letters as described above.

Elastic belts are used for the following aim. Elastic belts deform according to the toner layers and the roughness of the sheet having low smoothness at the transfer section. In other words, since the elastic belts deform to comply with local bumps and holes, a good contact is achieved without increasing the transfer pressure against the toner layers excessively so that it is possible to obtain transferred images having excellent uniformity without any drop out of letters even on sheets of paper of low flatness.

For the resin of the elastic belts, one or more can be selected from the group including polycarbonates, fluorine resins (ETFE, PVDF), styrene resins (homopolymers and copolymers including styrene or substituted styrene) such as polystyrene, chloropolystyrene, poly-α-methylstyrene, styrene-butadiene copolymer, styrene-vinyl chloride copolymer, styrene-vinyl acetate copolymer, styrene-maleic acid copolymer, styrene-acrylate copolymers (styrene-methyl acrylate copolymer, styrene-ethyl acrylate copolymer, styrene-butyl acrylate copolymer, styrene-octyl acrylate copolymer, and styrene-phenyl acrylate copolymer), styrene-methacrylate copolymers (styrene-methyl methacrylate copolymer, styrene-ethyl methacrylate copolymer, styrene-phenyl methacrylate copolymer, and the like), styrene-α-chloromethyl acrylate copolymer, styrene-acrylonitrile acrylate copolymer, and the like, methyl methacrylate resin, butyl methacrylate resin, ethyl acrylate resin, butyl acrylate resin, modified acrylic resins (silicone-modified acrylic resin, vinyl chloride resin-modified acrylic resin, acrylic urethane resin, and the like), vinyl chloride resin, styrene-vinyl acetate copolymer, vinyl chloride-vinyl acetate copolymer, rosin-modified maleic acid resin, phenol resin, epoxy resin, polyester resin, polyester polyurethane resin, polyethylene, polypropylene, polybutadiene, polyvinylidene chloride, ionomer resin, polyurethane resin, silicone resin, ketone resin, ethylene-ethylacrylate copolymer, xylene resin and polyvinylbutylal resin, polyamide resin, modified polyphenylene oxide resin, and the like. However, it is understood that the materials are not limited to those mentioned above.

For the rubber and elastomer of the elastic materials, one or more can be selected from the group including butyl rubber, fluorine rubber, acrylic rubber, ethylene propylene rubber (EPDM), acrylonitrilebutadiene rubber (NBR), acrylonitrile-butadiene-styrene natural rubber, isoprene rubber, styrene-butadiene rubber, butadiene rubber, ethylene-propylene rubber, ethylene-propylene terpolymer, chloroprene rubber, chlorosufonated polyethylene, chlorinated polyethylene, urethane rubber, syndiotactic 1,2-polybutadiene, epichlorohydrin rubber, silicone rubber, fluorine rubber, polysulfurized rubber, polynorbomen rubber, hydrogenated nitrile rubber, thermoplastic elastomers (such as polystyrene elastomers, polyolefin elastomers, polyvinyl chloride elastomers, polyurethane elastomers, polyamide elastomers, polyurea elastomers, polyester elastomers, and fluorine resin elastomers), and the like. However, it is understood that the materials are not limited to those mentioned above.

There are no limitations as to electric conductive agents for resistance adjustment, and examples include carbon black, graphite, metal powders such as aluminum, nickel, and the like; and electric conductive metal oxides such as tin oxide, titanium oxide, antimony oxide, indium oxide, potassium titanate, antimony tin oxide (ATO), indium tin oxide (ITO), and the like. The metal oxides may be coated on non-conducting particulates such as barium sulfate, magnesium silicate, calcium carbonate, and the like. It is understood that the conductive agents are not limited to those mentioned above.

Materials of the surface layer is required to prevent contamination of the photoconductor by the elastic material and to reduce the surface friction of the transfer belt so that toner adhesion is lessened and the cleanability and secondary transfer property are increased. For example, one or more of polyurethane, polyester, epoxy resin, and the like is used, and powders or particles of a material that reduces surface energy and enhances lubrication such as fluorine resin, fluorine compound, carbon fluoride, titanium dioxide, silicon carbide, or the like can be dispersed and used. One or more lubricant materials may be used or, alternatively, powders or particles of different sizes may be employed. In addition, it is possible to use a material such as fluorine rubber that is treated with heat so that a fluorine-rich layer is formed on the surface and the surface energy is reduced.

Several processes are listed below as examples of manufacturing processes of the belts, but the processes are not limited to these examples, and in general, two or more processes are combined for the manufacture of belts.

Centrifugal forming in which material is poured into a rotating cylindrical mold to form a belt Spray application in which a liquid paint is sprayed to form a film Dipping method in which a cylindrical mold is dipped into a solution of material and then pulled out Injection mold method in which material is injected between inner and outer mold A method in which a compound is applied onto a cylindrical mold and the compound is vulcanized and ground Methods to prevent elongation of the elastic belt include using a core resin layer that is difficult to elongate on which a rubber layer is formed, incorporating a material that prevents elongation into the core layer, and the like, but the methods are not particularly related with the manufacturing processes.

For materials that prevent elongation of a core layer, one or more can be selected from the group including, for example, natural fibers such as cotton, silk and the like; synthetic fibers such as polyester fibers, nylon fibers, acrylic fibers, polyolefin fibers, polyvinyl alcohol fibers, polyvinyl chloride fibers, polyvinylidene chloride fibers, polyurethane fibers, polyacetal fibers, polyfluoroethylene fibers, phenol fibers, and the like; inorganic fibers such as carbon fibers, glass fibers, boron fibers, and the like, metal fibers such as iron fibers, copper fibers, and the like, and materials is a form of a weave or thread can be used. It is understood naturally that the materials are not limited to those described above.

A thread may be one or more of filaments twisted together, and any twisting and plying is accepted such as single twisting, multiple twisting, doubled yarn, and the like. Further, fibers of different materials selected from the above-described group may be spun together. The thread may be treated before use in such a way that it is electrically conductive.

On the other hand, the weave may be of any type including plain knitting, and the like. It is naturally possible to use a union weave to apply electric conductive treatment.

The manufacturing process of the core layer is not particularly limited. For example, there is a method in which a weave that is woven in a cylindrical shape is placed on a mold or the like and a coating layer is formed on top of it. Another method uses a cylindrical weave being dipped in a liquid rubber or the like so that on one side or on both sides of the core layer, coating layer(s) is formed. In another example, a thread is wound helically to a mold or the like in an arbitrary pitch, and then a coating layer is formed thereon.

If the thickness of the elastic layer is too large, the elongation and contraction of the surface becomes large and may cause a crack on the surface layer although it depends on the hardness of the elastic layer. Moreover, if the amount of elongation and contraction is large, the size of images are elongated and contracted. Therefore, it is not preferred (about 1 mm or more).

(Tandem Color Image Forming Apparatus)

Figure 3:
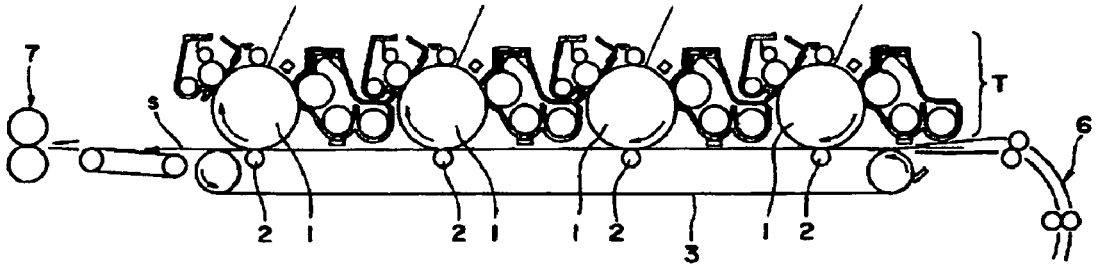
FIG. 3 is a schematic view describing an example of a configuration of an electrostatic image developing apparatus that incorporates a direct transfer method.
Figure 4:
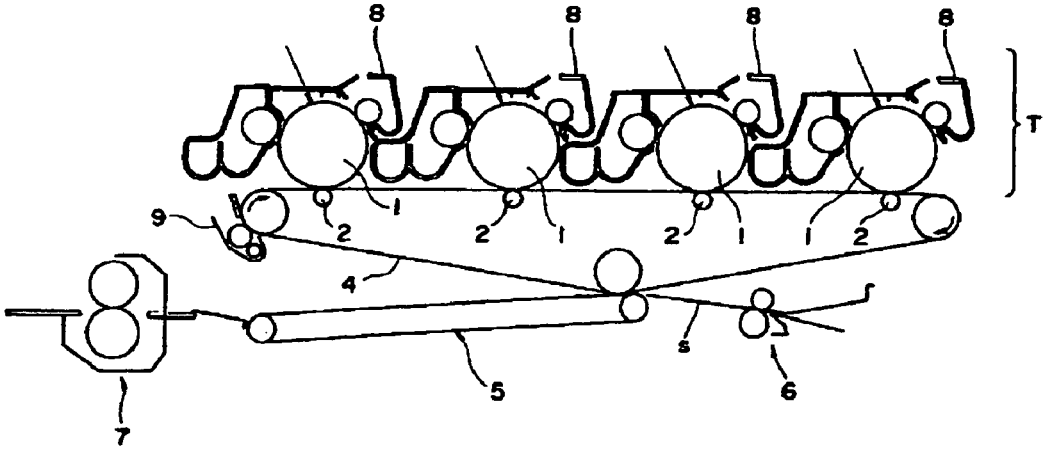
FIG. 4 is a schematic view describing an example of a configuration of an electrostatic image developing apparatus that incorporates an indirect transfer method.

The present invention can also be used as a tandem color image forming apparatus. An embodiment of the tandem color image forming apparatus will be described. There are two types of tandem electrophotographic apparatus. One is a direct transfer type as shown in FIG. 3 in which images on each photoconductor 1 are sequentially transferred by transfer devices 2 to a sheet s that is carried by a sheet carrying belt 3. The other is an indirect transfer type as shown in FIG. 4 in which images on each photoconductor 1 are initially transferred in sequence by primary transfer devices 2 to an intermediate transfer body 4 and then the image on the intermediate transfer body 4 is transferred by a secondary transfer device to a sheet s at once. The transfer device 5 here is a transfer carrying belt, but a roller can also be used.

When the direct transfer apparatus and the indirect transfer apparatus are compared, the former is disadvantageous in that it has to place a sheet feeder 6 in the upstream of a tandem image forming device T and a fusing device 7 at the downstream and therefore its size becomes large in the direction of the sheet being carried. In contrast, the latter can place the secondary transfer device relatively freely. It is advantageous in that the sheet feeder 6 and the fusing device 7 can be located under the tandem image forming device T so that it can be made smaller.

Moreover, if one attempts to reduce the size increase in the direction of the sheet carriage with the direct transfer apparatus, the fusing device 7 must be positioned close to the tandem image forming device T. Therefore, the fusing device 7 cannot be placed to provide the sheet s with enough space to bend and thus it is disadvantageous in that the fusing device 7 is likely to affect image formation in the upstream by the impact to the sheet s as the front edge of the sheet s enters the fusing device 7 (particularly apparent for a thick sheet) or by the difference of speed between sheet carrying speed while passing the fusing device 7 and that of the transfer carrying belt. On the other hand, in the indirect transfer apparatus, it is possible to position the fusing device 7 where sufficient space is available for the sheet s to bend, and therefore it can be designed so that the fusing device 7 has almost no effect on the image formation.

For such reasons, tandem electrophotographic apparatuses, especially indirect transfer type apparatuses, are recently gaining attention.

As shown in FIG. 4, in this type of color electrophotographic apparatuses, photoconductor cleaning devices 8 remove residual toner that is remaining on the photoconductors 1 after the primary transfer and clean the surface of the photoconductors 1 to prepare for the next image formation. Additionally, an intermediate transfer body cleaning device 9 remove residual toner that is remaining on the intermediate transfer body 4 after the secondary transfer and clean the surface of the intermediate transfer body 4 to prepare for the next image formation.

An embodiment of the present invention will be described with reference to figures hereinafter.

Figure 5:
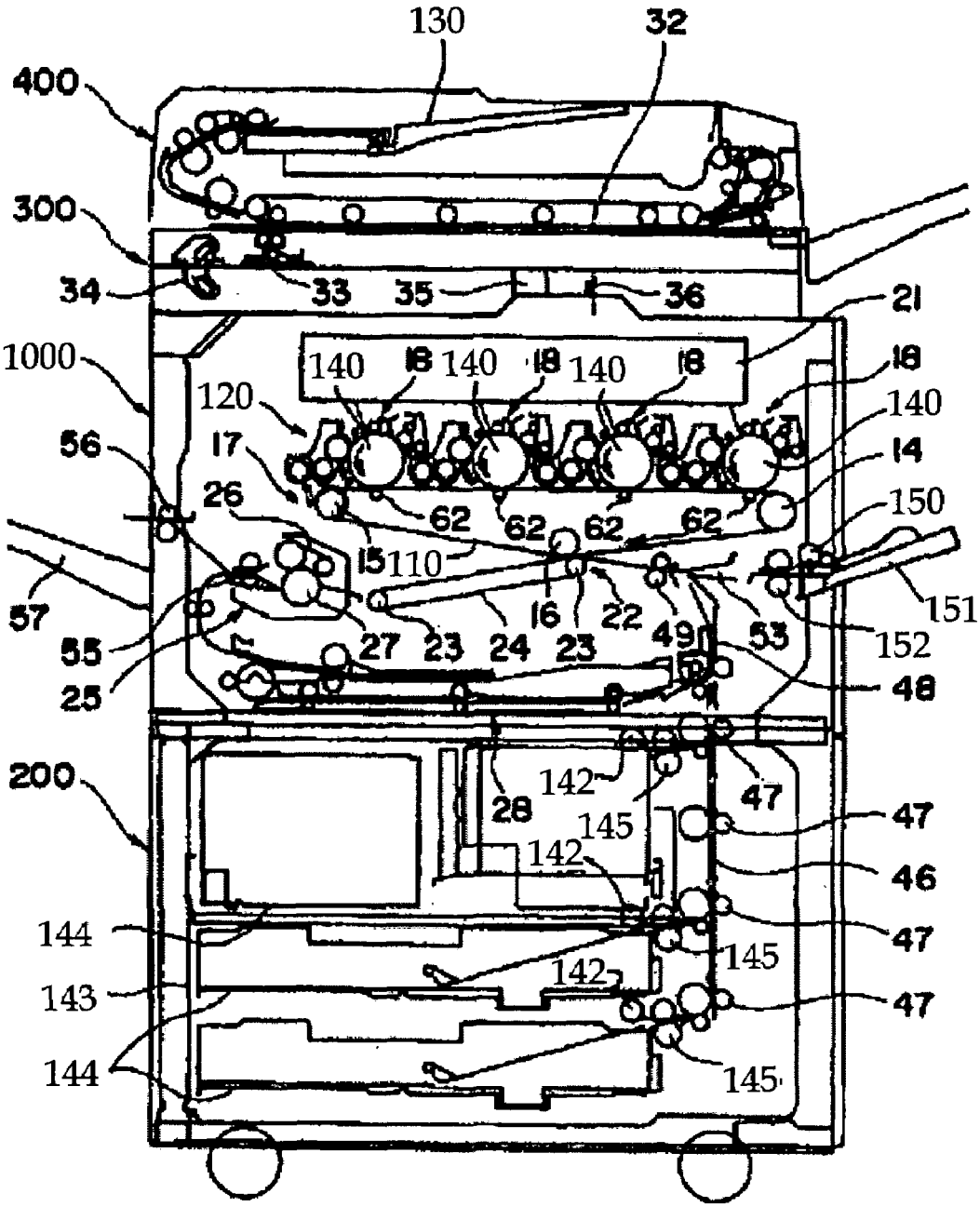
FIG. 5 is a schematic view describing an example of a configuration of an electrostatic image developing apparatus that incorporates a tandem indirect transfer method.

FIG. 5 shows an embodiment of the present invention, which is an indirect transfer tandem electrophotographic apparatus. The reference number 1000 represents the main body of copier apparatus, 200 a sheet feeder table, 300 a scanner that is mounted on the main body 1000, and 400 an automatic document feeder (ADF) that is mounted on top of the scanner 300. The main body 1000 has, in the middle, an intermediate transfer body 110, which is an endless belt.

In this embodiment as shown in FIG. 5, the intermediate transfer body 110 is suspended about three supporting rollers 14, 15, and 16, and is capable of rotating clockwise in the figure.

In this figure, an intermediate transfer body cleaning device 17 that removes toner remaining on the intermediate transfer body 110 after image transfer is located to the left of the second of the three supporting rollers 15.

In addition, over the section of the intermediate transfer body 110 that extends between the first supporting roller 14 and the second supporting roller 15, four image forming means 18, yellow, cyan, magenta, and black are horizontally arranged in this order along the direction of the rotation so as to configure a tandem image forming device 120.

Over the tandem image forming device 120, as shown in FIG. 5, an exposing device 21 is placed. On the other hand, at the opposite side of the intermediate transfer body 110 from the tandem image forming device 120, a secondary transfer device 22 is located. The secondary transfer device 22 has, in this figure, a secondary transfer belt 24, which is an endless belt, extended between two rollers 23, and is located so that it is being pressed against the third roller 16 through the intermediate transfer body 110 and therefore an image on the intermediate transfer body 110 can be transferred to a sheet.

A fusing device 25 that fuses a transferred image on a sheet is arranged to the side of the secondary transfer device 22. The fusing device 25 consists of a fusing belt 26, which is an endless belt, and a pressure roller 27 that is pressed against the fusing belt 26.

The secondary transfer device 22 also has a sheet carrying function that carries a sheet after image transfer to this fusing device 25. Of course, a transfer roller or a non-contact charger may be located as the secondary transfer device 22, but in such case it would be difficult for the device to have this sheet carrying function at the same time.

In this embodiment as shown in the figure, a sheet reversing device 28 that flips a sheet upside down in order to record images on both sides of the sheet is located below the secondary transfer device 22 and the fusing device 25 and parallel to the tandem image forming device 120.

Now, in order to take a copy using this color electrophotographic apparatus, an original document is set on a document table 130 of the ADF 400. Or, alternatively, the ADF 400 may be opened to set the document on a contact glass 32 of the scanner 300 and closed thereafter, and use the ADF 400 to hold the document.

Then, by pressing a start switch (not shown), the scanner 300 is activated and a first moving body 33 and a second moving body 34 start to move after the document is carried onto the contact glass 32 if it is set in the ADF 400, or, immediately after the start switch is pressed if the document is placed on the contact glass 32. Thereafter, light is irradiated from a light source in the first moving body 33, and reflected light from the document is once again reflected at the first moving body 33 toward the second moving body 34. Mirrors in the second moving body 34 reflect the light toward a reading sensor 36 through an imaging lens 35 and thus the content of the document is read.

By pressing the start switch (not shown), a drive motor (not shown) rotationally drives one of the supporting rollers 14, 15, and 16, and indirectly rotates two other supporting rollers so that the intermediate transfer body 110 is rotationally moved. At the same time, at each image forming means 18, its photoconductor 140 rotates, and monochrome images of black, yellow, magenta, and cyan are formed on each photoconductor 140. Then, as the intermediate transfer body 110 moves, these monochrome images are successively transferred to form a composite color image on the intermediate transfer body 110.

Also, by pressing the start switch (not shown), one of sheet feeder rollers 142 of the sheet feeder table 200 is selected and driven so as to advance a sheet from one of sheet feeder cassettes 144 that is stacked vertically in a paper bank 143. The sheet is separated from another by a separating roller 145 and advanced to a sheet feeder path 46. Then, carrying rollers 47 carries the sheet to a sheet feeder guide 48 in the main body 1000 where the sheet hits a resist roller 49 and is stopped.

Alternatively, sheet feeder roller 150 is rotated to advance a sheet from a manual bypass tray 151. Then, a separating roller 152 separates the sheet from other sheets and introduces the sheet to a manual bypass sheer feeder path 53 where the sheet hits a resist roller 49 and is stopped.

Then, the resist roller rotates in time with the composite color image on the intermediate transfer body 110 and advances the sheet between the intermediate transfer body 110 and the secondary transfer device 22 where the secondary transfer device 22 transfers onto the sheet to record the color image.

After the image transfer, the secondary transfer device 22 carries the sheet to the fusing device 25 where the fusing device 25 applies heat and pressure to fuse the transferred image. Thereafter, a switching flap 55 switches so that the sheet is ejected by an ejecting roller 56 and stacked on a paper output tray 57. Or alternatively, the switching flap 55 switches so that the sheet enters the sheet reversing device 28 where the sheet is reversed and advanced once again to transfer section. Then, an image is recorded on the reverse side of the sheet and thereafter the ejecting roller 56 ejects the sheet to the paper output tray 57.

After image transfer, the intermediate transfer body cleaning device 17 removes residual toner remaining on the intermediate transfer body 110 so that the intermediate transfer body 110 is ready for the next image forming by the tandem image forming device 120.

The resist roller 49 is generally grounded in many cases, but a bias may be applied in order to remove paper dust on a sheet.

Figure 6:
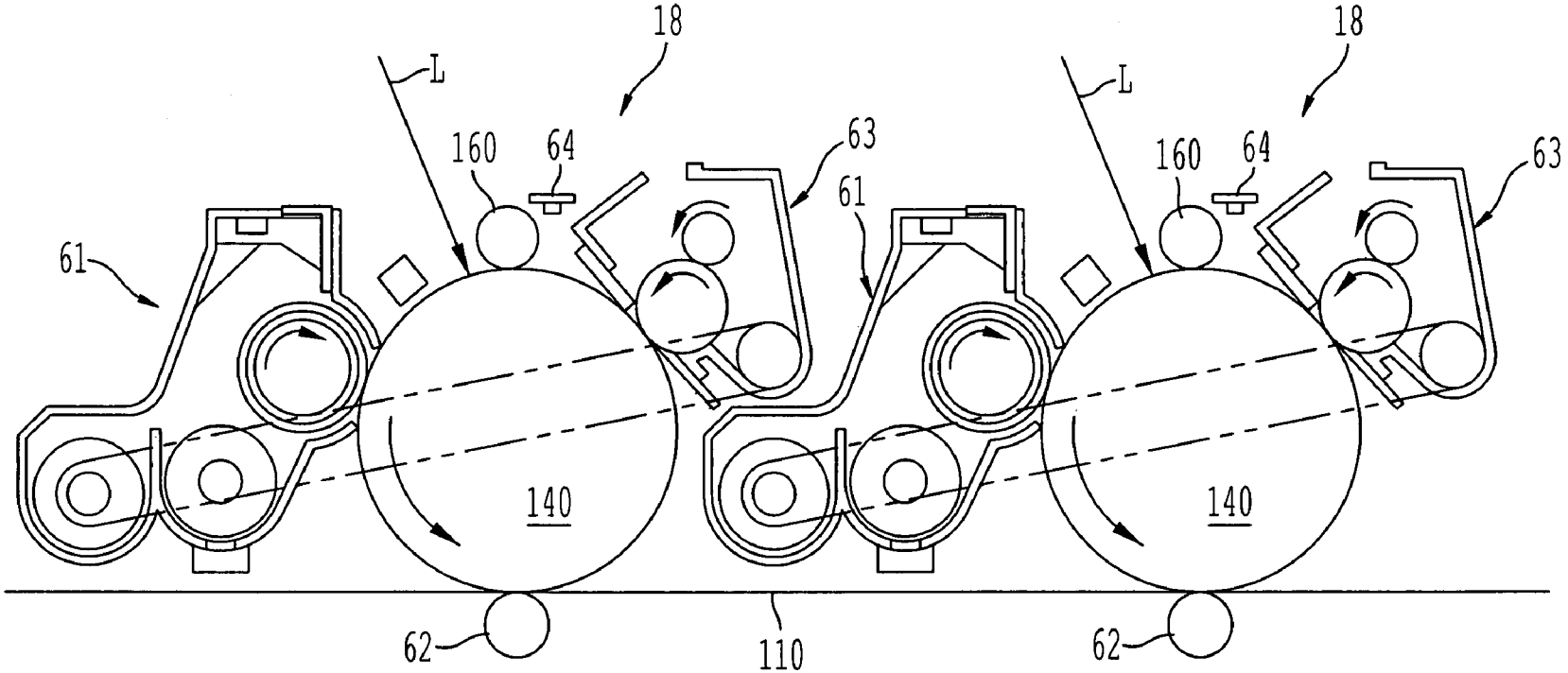
FIG. 6 is a schematic view of an example of a configuration of a plurality of means for forming an image in a tandem image forming apparatus.

Each image forming means 18 in the tandem image forming device 120, as is shown in FIG. 6 with more detail, comprises, for example, a charging device 160, developing device 61, primary transfer device 62 (also shown in FIG. 5), photoconductor cleaning device 63, charge removing device 64, and the like located around a photoconductor 140 having the shape of a drum.

(Toner Container)

A toner container of the present invention contains a toner and/or a developer of the present invention therein.

The container is not particularly limited, and it can be selected appropriately from those known in the art. Suitable examples include a toner container including a main body and a cap and the like.

The main body is not particularly limited with regards to its size, shape, structure, material, or the like, and can be appropriately selected according to the purpose. For example, a cylinder shape is preferable. By forming spiral furrows or ridges on the inner surface of the cylinder, a rotation of the cylinder can move the toner that is contained it the cylindrical container toward an outlet. It is particularly preferable when a part or all of the spiral furrows or ridges have a function that resembles bellows.

The material of the toner container is not particularly limited, and those having dimensional accuracy are preferable. For example, resins can be used. Among resins, polyester resin, polyethylene resin, polypropylene resin, polystyrene resin, polyvinyl chloride, polyacrylic acid, polycarbonate resin, ABS resin, polyacetal resin, and the like are suitable.

Storage, transportation, and the like are simple for a toner container of the present invention, and handling properties are excellent. It can be detachably fixed to a process cartridge, image forming apparatus, or the like of the present invention, and can suitable be used for supplying toner.

(Process Cartridge)

A process cartridge of the present invention comprises an electrostatic latent image substrate that supports an electrostatic latent image, means for developing the electrostatic latent image using a developer to form a visible image, and other optional means that are appropriately selected if needed.

The means for developing includes a developer container that contains a toner or a developer of the present invention, and a developer substrate that supports and carries the toner or developer. It may further include other components such as a layer thickness-restricting member that restricts the thickness of toner layer formed on the substrate, or the like.

A process cartridge of the present invention can be detachably equipped in various electrophotographic apparatuses, and it is preferably equipped in an electrophotographic apparatus of the present invention.

EXAMPLES

The present invention will be described in more detail referring to examples hereinafter. It should be understood that the examples do not limit the scope of the present invention. In the following examples, "part(s)" means part(s) by weight.

First, evaluation method of toner properties will be described.

(Evaluated Properties and Evaluation Methods)

1) Particle Diameter

Particle diameters were measured using a Coulter Electronics particle diameter meter "Coulter Counter TAII" with an aperture diameter of 100 μm. The volume mean particle diameter Dv and number mean particle diameter Dn were calculated using the above particle diameter meter.

2) Average Sphericity E

Average sphericity E can be measured by a flow particle image analyzer FPIA-1000 (To a Medical Electronics). Specifically, the measurement was performed by adding 0.3 ml of surfactant, preferably alkylbenzene sulfonate, as a dispersing agent to 120 ml of water in a container from which solid impurities had been previously removed, and then adding approximately 0.2 g of measurement sample. The suspension in which the sample was dispersed was subjected to dispersion treatment for approximately 2 minutes by an ultrasonic disperser to adjust particle concentration to about 5,000 dispersion particles/μl, and toner shape and distribution were measured with the analyzer. Thus the sphericity is measured.

3) Sphericity Factors SF-1 and SF-2

An S-4200 FE-SEM (Hitachi Ltd.) is used to obtain SEM images of toner particles. Then, 300 images are randomly selected, and the information of the images is introduced to a LUZEX AP image analyzer (Nireco Corporation) through an interface and analyzed by the device.

4) Fusibility

An imagio Neo 450 (Ricoh Co., Ltd.) is modified to a belt fusing system. Using the modified copier, solid images with adhering toner amount of 1.0±0.1 mg/cm$^2$ were printed on sheets of plain paper and thick paper (available from Ricoh, Type 6200 and from NBS Ricoh Co., Ltd., copy and print paper<135>). Fusing tests were conducted with different fusing temperatures at the fusing belt, and the highest temperature at which no hot offset occurred on plain paper sheets was determined as highest fusing temperature. Also, lowest fusing temperature was measured using thick paper sheets. The lowest fusing temperature is determined as the temperature of a fusing roller at which a fused image is rubbed with a pad and the remaining rate of the image density of the fused image is 70% or more. It is desirable that the highest fusing temperature is 190° C. or more and the lowest fusing temperature is 140° C. or less.

5) Cleanability

After an output of 100 sheets and cleaning process, transfer residual toner on a photoconductor is transferred to a white sheet of paper using SCOTCH TAPE (available from Sumitomo 3M). The sheet is then measured with a Macbeth reflection densitometer RD 514 and the difference between a sample and a blank is evaluated. The sample is rated as Very Good when the difference is less than 0.005, Good when the difference is from 0.005 to 0.010, Fair when the difference is from 0.011 to 0.02, and Poor when the difference is more than 0.02.

6) Charge Stability

An IPSiO Color 8100 (Ricoh Co., Ltd.) is modified and tuned to an oil-less fusing system. Using the modified evaluation copier, the difference of charge amount for each toner was measured by conducting an endurance test of 100,000-sheet successive output with chart images of 5% toner coverage. The charge amount difference is obtained from 1 g of developer with a blow off method. Each toner was evaluated as Good when the difference is 5 μc/g or less, Fair when the difference is 10 μc/g or less, and Poor when the difference is more than 10 μc/g.

7) Image Density

An imagio Neo 450 (Ricoh Co., Ltd.) is modified to a belt fusing system. Using the modified copier, solid images with adhering toner amount of 0.4±0.1 mg/cm$^2$ were printed on sheets of plain paper (available from Ricoh, Type 6200). Then, the image density of the sheets were measured with an X-Rite (available from X-Rite), and evaluated as Good when the image density is 1.4 or more and Poor if it is less.

8) Image Graininess and Sharpness

An IPSiO Color 8100 (Ricoh Co., Ltd.) is modified and tuned to an oil-less fusing system. Using the modified evaluation copier, photographic images were output in monochrome and the levels of graininess and sharpness were evaluated with naked eyes as Very Good, Good, Fair, and Poor, in this order, from better to worse. Very Good indicates the image is comparative to offset prints, Good indicates that it is slightly inferior to offset prints, Fair indicates the image is considerably inferior to offset prints, and Poor indicates the image is as good as conventional electrophotographic images and is very bad.

9) Fog

An IPSiO Color 8100 (Ricoh Co., Ltd.) is modified and tuned to an oil-less fusing system. Using the modified evaluation copier at temperature of 10° C. and humidity of 15%, an endurance test of 100,000-sheet successive output with chart images of 5% toner coverage was conducted. Then, toner contamination of the background portion of a printed sheets is evaluated with eyes using a magnifier as Very Good, Good, Fair, and Poor, in this order, from better to worse. Very Good indicates the toner contamination is not observe bed at all and is in a good condition, Good indicates that very little contamination is observed and is not so much of a problem, Fair indicates that some contamination is observed, and Poor indicates that the contamination is more than acceptable, very dirty, and is problematic.

10) Toner Scatter

An IPSiO Color 8100 (Ricoh Co., Ltd.) is modified and tuned to an oil-less fusing system. Using the modified evaluation copier at temperature of 40° C. and humidity of 90%, an endurance test of 100,000-sheet successive output with chart images of 5% toner coverage was conducted. Then, toner contamination inside the copier is evaluated with naked eyes. Very Good indicates the toner contamination is not observe bed at all and is in a good condition, Good indicates that very little contamination is observed and is not so much of a problem, Fair indicates that some contamination is observed, and Poor indicates that the contamination is more than acceptable, very dirty, and is problematic.

11) Environmental Preservability

A sample of each toner was taken in an amount of 10 g and put in a 20 ml glass container. After the container was tapped for 100 times, it was set in a thermostat at a temperature of 55° C. and humidity of 80% for 24 hours. Then, penetration is measured using a penetrometer. In addition, penetration of toner samples that were kept in a cold and dry environment (10° C., 15%) was also measured, and the lower value of penetration of the two conditions, hot and humid and cold and dry, was used for evaluation. The samples were evaluated as Very Good when the penetration was 20 mm or more, Good when it was 15 mm or more and less than 20 mm, Fair when it was 10 mm or more and less than 15 mm, and Poor when it was less than 10 mm.

(Evaluation of Two Component Developers)

Evaluations for two component developers were conducted in the following manner. Using ferrite carriers with an average diameter of 35 μm on which a silicone resin is coated to an average thickness of 0.5 μm, 100 parts by weight of the carriers were uniformly mixed with 7 parts by weight of toner of each color in a turbulator mixer in which a container rotates to mix the materials so as to charge the mixture and thus a developer was prepared.

[Process for Manufacturing Carriers]

| | |
|---|---|
| Core material | |
| Cu—Zn ferrite particles (weight mean diameter: 35 μm): | 5,000 parts |
| Coating materials | |
| Toluene: | 450 parts |
| Silicone resin SR 2400: (available from Dow Corning Toray Silicone Co., Ltd., non-volatile portion 50%) | 450 parts |
| Aminosilane SH 6020: (available from Dow Corning Toray Silicone Co., Ltd.) | 10 parts |
| Carbon black: | 10 parts |

The above described coating materials were dispersed for 10 minutes using a stirrer to prepare a coating dispersion. The coating dispersion and core material was poured in a coating apparatus that had a rotating base plate disk and stirring blades in a fluidized bed to form a whirling flow and conduct coating. Thus the coating dispersion was applied onto the core material. The coated material was then baked in an electric oven at 250° C. for 2 hours and thus the carriers were made.

Example 1

Manufacture Example 1

(Synthesis of Organic Particulate Emulsion)

To a reaction vessel provided with a stirrer and thermometer, 683 parts of water, 11 parts of the sodium salt of the sulfuric acid ester of methacrylic acid ethylene oxide adduct (ELEMINOL RS-30, Sanyo Chemical Industries, Ltd.), 83 parts of styrene, 83 parts of methacrylic acid, 110 parts of butyl acrylate, and 1 part of ammonium persulphate were introduced, and stirred at 3800 rpm/min for 30 minutes to give a white emulsion. This was heated, the temperature in the system was raised to 75° C. and the reaction performed for 4 hours. Next, 30 parts of an aqueous solution of 1% ammonium persulphate was added, and the reaction mixture was matured at 75° C. for 6 hours to obtain an aqueous dispersion of a vinyl resin "particulate emulsion 1" (copolymer of styrene-methacrylic acid-butyl acrylate-sodium salt of the sulfuric acid ester of methacrylic acid ethylene oxide adduct). The volume mean particle diameter of "particulate emulsion 1" measured by LA-920 was 110 nm. After drying part of "particulate emulsion 1" and isolating the resin, Tg of the resin was 58° C. and the volume average molecular weight was 130,000.

Manufacture Example 2

(Preparation of Aqueous Phase)

To 990 parts of water, 83 parts of "particulate emulsion 1," 37 parts of a 48.3% aqueous solution of sodium dodecyl diphenylether disulfonic acid (ELEMINOL MON-7: Sanyo Chemical Industries, Ltd.) and 90 parts of ethyl acetate were mixed and stirred together to obtain a milky liquid. This was taken as "aqueous phase 1."

Manufacture Example 3

(Synthesis of Low Molecular Weight Polyester)

In a reaction vessel equipped with a condenser, stirrer, and nitrogen inlet tube, 229 parts of bisphenol A ethylene oxide dimolar adduct, 529 parts of bisphenol A propylene oxide trimolar adduct, 208 parts of terephthalic acid, 46 parts of adipic acid and 2 parts of dibutyl tin oxide were placed, and the reaction was performed under normal pressure at 230° C. for 7 hours, and under a reduced pressure of 10–15 mmHg for 5 hours, then 44 parts of anhydrous trimellitic acid was introduced into the reaction vessel, and the reaction performed at 180° C. under normal pressure for 3 hours to obtain "low molecular weight polyester 1." The "low molecular weight polyester 1" had a number mean molecular weight of 2,300, weight mean molecular weight of 6,700, Tg of 43° C. and acid value of 25.

Manufacture Example 4

(Synthesis of Intermediate Polyester)

In a reaction vessel equipped with a condenser, stirrer, and nitrogen inlet tube, 682 parts of bisphenol A ethylene oxide dimolar adduct, 81 parts of bisphenol A propylene oxide dimolar adduct, 283 parts of terephthalic acid, 22 parts of anhydrous trimellitic acid and 2 parts of dibutyl tin oxide were placed, and the reaction was performed under normal pressure at 230° C. for 7 hours, and then under a reduced pressure of 10 mmHg to 15 mmHg for 5 hours to obtain "intermediate polyester 1." The "intermediate polyester 1" had a number average molecular weight of 2,200, weight average molecular weight of 9,700, Tg of 54° C., acid value of 0.5 and hydroxyl value of 52. Next, 410 parts of "intermediate polyester 1," 89 parts of isohorone diisocyanate and 500 parts of ethyl acetate were placed in a reaction vessel equipped with a condenser, stirrer, and nitrogen inlet tube, and the reaction was performed at 100° C. for 5 hours to obtain "prepolymer 1." The free isocyanate % by weight of "prepolymer 1" was 1.53%.

Manufacture Example 5

(Synthesis of Ketimine)

Into a reaction vessel equipped with a stirrer and thermometer, 170 parts of isohorone diamine and 75 parts of methyl ethyl ketone were introduced, and the reaction was performed at 50° C. for 4 and a half hours to obtain "ketimine compound 1." The amine value of "ketimine compound 1" was 417.

Manufacture Example 6

(Synthesis of Masterbatch (MB))

To 1200 parts of water, 540 parts of carbon black (PRINTEX 35, Degussa AG) [DBP oil absorption amount=42 ml/100 mg, pH=9.5] and 1200 parts of polyester resin were added and mixed in a HENSCHEL MIXER (Mitsui Mining), then the mixture was kneaded at 150° C. for 1 hour using two rollers, extrusion cooled and crushed with a pulverizer to obtain "masterbatch 1."

Manufacture Example 7

(Preparation of Oil Phase)

Into a vessel equipped with a stirrer and thermometer, 378 parts of "low molecular weight polyester 1," 100 parts of carnauba wax, and 947 parts of ethyl acetate were introduced, and the temperature was raised to 80° C. with stirring, maintained at 80° C. for 5 hours, and cooled to 30° C. in 1 hour. Next, 500 parts of "masterbatch 1" and 500 parts of ethyl acetate were introduced into the vessel, and mixed for 1 hour to obtain "initial material solution 1."

To a vessel, 1324 parts of "initial material solution 1" were transferred, and carbon black and wax were dispersed using a bead mill (ultra bead mill, Imex) under the conditions of liquid feed rate 1 kg/hr, disk circumferential speed of 6 m/sec, 0.5 mm zirconia beads packed to 80% volume % and 3 passes. Next, 1324 parts of a 65% ethyl acetate solution of "low molecular weight polyester 1" was added and dispersed in 2 passes by the bead mill under the aforesaid conditions to obtain "pigment/WAX dispersion 1". The solids concentration of "pigment/WAX dispersion 1" (130° C., 30 minutes) was 50%.

Manufacture Example 8

(Emulsification and Solvent Removal)

In a vessel, 749 parts of "pigment/WAX dispersion 1," 115 parts of "prepolymer 1" and 2.9 parts of "ketimine compound 1" were placed and mixed at 5,000 rpm for 2 minutes by a TK homomixer (Special Machinery), then 1200 parts of "aqueous phase 1" were added to the vessel and mixed in the TK homomixer at a rotation speed of 13,000 rpm for 25 minutes to obtain "emulsion slurry 1." "Emulsion slurry 1" was placed in a vessel equipped with a stirrer and thermometer, then the solvent was removed at 30° C. for 8 hours and the product was matured at 45° C. for 7 hours to obtain "dispersion slurry 1."

Manufacture Example 9

(Rinsing and Drying)

After filtering 100 parts of "dispersion slurry 1" under reduced pressure, (1): 100 parts of ion exchange water were added to the filter cake, mixed in a TK homomixer (rotation speed 12000 rpm, 10 minutes) and filtered.

(2): 100 parts of 10% sodium hydroxide were added to the filter cake of (1), mixed in a TK homomixer (rotation speed 12000 rpm, and 30 minutes) and filtered under reduced pressure.

(3): 100 parts of 10% hydrochloric acid were added to the filter cake of (2), mixed in a TK homomixer (rotation speed 12000 rpm, 10 minutes) and filtered.

(4): 300 parts of ion exchange water were added to the filter cake of (3), mixed in a TK homomixer (rotation speed 12000 rpm, 10 minutes), and filtered twice to obtain "filter cake 1."

"Filter cake 1" was dried in a circulating air dryer at 45° C. for 48 hours, and sieved through a sieve of 75 μm mesh to obtain "toner base particles 1." Then, 100 parts of the "toner base particles 1" and 1 part of hydrophobic silica were mixed in a HENSCHEL MIXER to obtain "toner 1." The properties of "toner 1" are shown in Table 1, and evaluation results thereof are shown in Table 2.

Example 2

A toner is obtained in the same manner as Example 1 except that the process for emulsification and solvent removal was changed to conditions as described below. The properties of obtained toner are shown in Table 1, and evaluation results thereof are shown in Table 2.

Manufacture Example 10

(Emulsification and Solvent Removal)

In a vessel, 749 parts of "pigment/WAX dispersion 1," 115 parts of "prepolymer 1" and 2.9 parts of "ketimine compound 1" were placed and mixed at 5,000 rpm for 1 minute by a TK homomixer (Special Machinery), then 1200 parts of "aqueous phase 1" were added to the vessel and mixed in the TK homomixer at a rotation speed of 13,000 rpm for 25 minutes to obtain "emulsion slurry 2."

"Emulsion slurry 2" was placed in a vessel equipped with a stirrer and thermometer, then the solvent was removed at 30° C. for 8 hours and the product was matured at 45° C. for 5 hours to obtain "dispersion slurry 2."

Example 3

A toner is obtained in the same manner as Example 1 except that the process for emulsification and solvent removal was changed to conditions as described below. The properties of obtained toner are shown in Table 1, and evaluation results thereof are shown in Table 2.

Manufacture Example 11

(Emulsification and Solvent Removal)

In a vessel, 749 parts of "pigment/WAX dispersion 1," 115 parts of "prepolymer 1" and 2.9 parts of "ketimine compound 1" were placed and mixed at 5,000 rpm for 1 minute by a TK homomixer (Special Machinery), then 1200 parts of "aqueous phase 1" were added to the vessel and mixed in the TK homomixer at a rotation speed of 13,000 rpm for 15 minutes to obtain "emulsion slurry 3."

"Emulsion slurry 3" was placed in a vessel equipped with a stirrer and thermometer, then the solvent was removed at 30° C. for 8 hours and the product was matured at 45° C. for 7 hours to obtain "dispersion slurry 3."

Example 4

A toner is obtained in the same manner as Example 1 except that the process for emulsification and solvent removal was changed to conditions as described below. The properties of obtained toner are shown in Table 1, and evaluation results thereof are shown in Table 2.

Manufacture Example 12

(Emulsification and Solvent Removal)

In a vessel, 749 parts of "pigment/WAX dispersion 1," 115 parts of "prepolymer 1" and 2.9 parts of "ketimine compound 1" were placed and mixed at 5,000 rpm for 1 minute by a TK homomixer (Special Machinery), then 1200 parts of "aqueous phase 1" were added to the vessel and mixed in the TK homomixer at a rotation speed of 12,000 rpm for 2 hours to obtain "emulsion slurry 4."

"Emulsion slurry 4" was placed in a vessel equipped with a stirrer and thermometer, then the solvent was removed at 30° C. for 8 hours and the product was matured at 45° C. for 8 hours to obtain "dispersion slurry 4."

Example 5

A toner is obtained in the same manner as Example 1 except that the process for emulsification and solvent removal was changed to conditions as described below. The properties of obtained toner are shown in Table 1, and evaluation results thereof are shown in Table 2.

Manufacture Example 13

(Emulsification and Solvent Removal)

In a vessel, 749 parts of "pigment/WAX dispersion 1," 115 parts of "prepolymer 1" and 2.9 parts of "ketimine compound 1" were placed and mixed at 5,000 rpm for 1 minute by a TK homomixer (Special Machinery), then 1200 parts of "aqueous phase 1" were added to the vessel and mixed in the TK homomixer at a rotation speed of 14,000 rpm for 20 minutes to obtain "emulsion slurry 5."

"Emulsion slurry 5" was placed in a vessel equipped with a stirrer and thermometer, then the solvent was removed at 30° C. for 10 hours and the product was matured at 45° C. for 8 hours to obtain "dispersion slurry 5."

Example 6

A toner is obtained in the same manner as Example 1 except that the process for emulsification and solvent removal was changed to conditions as described below. The properties of obtained toner are shown in Table 1, and evaluation results thereof are shown in Table 2.

Manufacture Example 14

(Emulsification and Solvent Removal)

In a vessel, 749 parts of "pigment/WAX dispersion 1," 115 parts of "prepolymer 1" and 2.9 parts of "ketimine compound 1" were placed and mixed at 5,000 rpm for 1 minute by a TK homomixer (Special Machinery), then 1200 parts of "aqueous phase 1" were added to the vessel and mixed in the TK homomixer at a rotation speed of 13,000 rpm for 20 minutes to obtain "emulsion slurry 6."

"Emulsion slurry 6" was placed in a vessel equipped with a stirrer and thermometer, then the solvent was removed at 30° C. for 10 hours and the product was matured at 40° C. for 3 hours to obtain "dispersion slurry 6."

Example 7

A toner is obtained in the same manner as Example 1 except that the process for emulsification and solvent removal was changed to conditions as described below. The properties of obtained toner are shown in Table 1, and evaluation results thereof are shown in Table 2.

Manufacture Example 15

(Emulsification and Solvent Removal)

In a vessel, 749 parts of "pigment/WAX dispersion 1," 115 parts of "prepolymer 1" and 2.9 parts of "ketimine compound 1" were placed and mixed at 5,000 rpm for 1 minute by a TK homomixer (Special Machinery), then 1200 parts of "aqueous phase 1" were added to the vessel and mixed in the TK homomixer at a rotation speed of 13,000 rpm for 20 minutes to obtain "emulsion slurry 7."

"Emulsion slurry 7" was placed in a vessel equipped with a stirrer and thermometer, then the solvent was removed at 30° C. for 10 hours and the product was matured at 50° C. for 20 hours to obtain "dispersion slurry 7."

Example 8

A toner is obtained in the same manner as Example 1 except that the process for preparation of an aqueous phase was changed to conditions as described below. The properties of obtained toner are shown in Table 1, and evaluation results thereof are shown in Table 2.

Manufacture Example 16

(Preparation of Aqueous Phase)

To 990 parts of water, 50 parts of "particulate emulsion 1," 35 parts of a 48.3% aqueous solution of sodium dodecyl diphenylether disulfonic acid (ELEMINOL MON-7: Sanyo Chemical Industries, Ltd.) and 80 parts of ethyl acetate were mixed and stirred together to obtain a milky liquid. This was taken as "aqueous phase 2."

Example 9

A toner is obtained in the same manner as Example 1 except that the process for preparation of an oil phase was changed to conditions as described below. The properties of obtained toner are shown in Table 1, and evaluation results thereof are shown in Table 2.

Manufacture Example 17

(Preparation of Oil Phase)

Into a vessel equipped with a stirrer and thermometer, 378 parts of "low molecular weight polyester 1," 100 parts of carnauba/rice wax (weight ratio of carnauba to rice is 7 to 3), and 947 parts of ethyl acetate were introduced, and the temperature was raised to 80° C. with stirring, maintained at 80° C. for 5 hours, and cooled to 30° C. in 1 hour. Next, 500 parts of "masterbatch 1" and 500 parts of ethyl acetate were introduced into the vessel, and mixed for 1 hour to obtain "initial material solution 2."

To a vessel, 1324 parts of "initial material solution 2" were transferred, and carbon black and wax were dispersed using a bead mill (ultra bead mill, Imex) under the conditions of liquid feed rate 1 kg/hr, disk circumferential speed of 6 m/sec, 0.5 mm zirconia beads packed to 80% volume % and 3 passes. Next, 1324 parts of a 65% ethyl acetate solution of "low molecular weight polyester 1" was added and dispersed in 2 passes by the bead mill under the aforesaid conditions to obtain "pigment/WAX dispersion 2." The solid concentration of "pigment/WAX dispersion 2" (130° C., 30 minutes) was 50%.

Example 10

A toner is obtained in the same manner as Example 1 except that the process for preparation of an oil phase was changed to conditions as described below. The properties of obtained toner are shown in Table 1, and evaluation results thereof are shown in Table 2.

Manufacture Example 18

(Preparation of Oil Phase)

Into a vessel equipped with a stirrer and thermometer, 378 parts of "low molecular weight polyester 1," 100 parts of carnauba/rice wax (weight ratio of carnauba to rice is 8 to 2), and 947 parts of ethyl acetate were introduced, and the temperature was raised to 80° C. with stirring, maintained at 80° C. for 5 hours, and cooled to 30° C. in 1 hour. Next, 500 parts of "masterbatch 1" and 500 parts of ethyl acetate were introduced into the vessel, and mixed for 1 hour to obtain "initial material solution 3."

To a vessel, 1324 parts of "initial material solution 3" were transferred, and carbon black and wax were dispersed using a bead mill (ultra bead mill, Imex) under the conditions of liquid feed rate 1 kg/hr, disk circumferential speed of 6 m/sec, 0.5 mm zirconia beads packed to 80% volume % and 3 passes. Next, 1324 parts of a 65% ethyl acetate solution of "low molecular weight polyester 1" was added and dispersed in 4 passes by the bead mill under the aforesaid conditions to obtain "pigment/WAX dispersion 3." The solid concentration of "pigment/WAX dispersion 3" (130° C., 30 minutes) was 50%.

Example 11

A toner is obtained in the same manner as Example 1 except that the process for preparation of an oil phase was changed to conditions as described below. The properties of obtained toner are shown in Table 1, and evaluation results thereof are shown in Table 2.

Manufacture Example 19

(Preparation of Oil Phase)

Into a vessel equipped with a stirrer and thermometer, 378 parts of "low molecular weight polyester 1," 100 parts of carnauba/rice wax (weight ratio of carnauba to rice is 5 to 5), and 947 parts of ethyl acetate were introduced, and the temperature was raised to 80° C. with stirring, maintained at 80° C. for 5 hours, and cooled to 30° C. in 1 hour. Next, 500 parts of "masterbatch 1" and 500 parts of ethyl acetate were introduced into the vessel, and mixed for 1 hour to obtain "initial material solution 4."

To a vessel, 1324 parts of "initial material solution 4" were transferred, and carbon black and wax were dispersed using a bead mill (ultra bead mill, Imex) under the conditions of liquid feed rate 1 kg/hr, disk circumferential speed of 6 m/sec, 0.5 mm zirconia beads packed to 80% volume % and 3 passes. Next, 1324 parts of a 65% ethyl acetate solution of "low molecular weight polyester 1" was added and dispersed in 3 passes by the bead mill under the aforesaid conditions to obtain "pigment/WAX dispersion 4." The solid concentration of "pigment/WAX dispersion 4" (130° C., 30 minutes) was 50%.

Comparative Example 1

<First Step>

[Preparation of Dispersion (1)]

| | |
|---|---|
| Styrene: | 370 g |
| n-butylacrylate: | 30 g |
| Acrylic acid: | 8 g |
| Dodecanthiol: | 24 g |
| Carbontetrabromide: | 4 g |

These materials were mixed and dissolved and were then added to a flask of 550 g of ion-exchanged water in which 6 g of nonionic surfactant (NONIPOL 400, available from Sanyo Chemical) and 10 g of anionic surfactant (NEOGEN SC, available from Dai-ichi Kogyo Seiyaku Co., Ltd.) were dissolved. The mixture was then dispersed, emulsified, and slowly mixed for 10 minutes while adding ion-exchanged water in which 4 g of ammonium persulfate is dissolved. Nitrogen substitution is conducted, and the flask is heated in an oil bath with stirring until the mixture is 70° C., and it was kept for 5 hours so that emulsion polymerization was allowed to continue. As a result, a dispersion (1) containing resin particles having an average diameter of 155 nm, glass transition point of 59° C., and weight average molecular weight (Mw) of 12,000 was prepared.

[Preparation of Dispersion (2)]

| | |
|---|---|
| Styrene: | 280 g |
| n-butylacrylate: | 120 g |
| acrylic acid: | 8 g |

These materials were mixed and dissolved and were then added to a flask of 550 g of ion-exchanged water in which 6 g of nonionic surfactant (NONIPOL 400, available from Sanyo Chemical) and 12 g of anionic surfactant (NEOGEN SC, available from Dai-ichi Kogyo Seiyaku Co., Ltd.) were dissolved. The mixture was then dispersed, emulsified, and slowly mixed for 10 minutes while adding ion-exchanged water in which 3 g of ammonium persulfate is dissolved. Nitrogen substitution is conducted, and the flask is heated in an oil bath with stirring until the mixture is 70° C., and it was kept for 5 hours so that emulsion polymerization was allowed to continue. As a result, a dispersion (2) containing resin particles having an average diameter of 105 nm, glass transition point of 53° C., and weight average molecular weight (Mw) of 550,000 was prepared.

[Preparation of Colorant Dispersion (1)]

| | |
|---|---|
| Carbon black: (available from Cabot Corporation: Mogul L) | 50 g |
| Nonionic surfactant: (available from Sanyo Chemicals: NONIPOL 400) | 5 g |
| Ion-exchanged water: | 200 g. |

These materials were mixed and dissolved, and then dispersed for 10 minutes using a homogenizer (available from IKA: ULTRA TURRAX T50). Thus, a colorant dispersion (1) containing colorant (carbon black) having an average diameter of 250 nm dispersed therein was prepared.

[Preparation of Release Agent Dispersion (1)]

| | |
|---|---|
| Paraffin wax: (available from Nippon Seiro Co., Ltd.; HNP0190, melting point 85° C.) | 50 g |
| Cationic surfactant: (available from Kao Corporation: SANISOL B50) | 5 g |
| Ion-exchanged water: | 200 g. |

These materials were heated to 95° C., dispersed using a homogenizer (available from IKA: ULTRA TURRAX T50), and thereafter dispersed using a high-pressure homogenizer. Thus, a release agent dispersion (1) containing release agent having an average diameter of 550 nm dispersed therein was prepared.

[Prearation of Aggregated Particles]

| | |
|---|---|
| Dispersion (1): | 120 g |
| Dispersion (2): | 80 g |
| Colorant dispersion (1): | 30 g |
| Release agent dispersion (1): | 40 g |
| Cationic surfactant: (available from Kao Corporation: SANISOL B50). | 1.5 g |

These materials were mixed in a round stainless flask and dispersed using a homogenizer (available from IKA: ULTRA TURRAX T50). Then, the flask was put in a heating oil bath and heated with stirring to 48° C. The flask was kept at 48° C. for 30 minutes and thereafter the mixture was observed with an optical microscope. It was observed that aggregated particles having an average diameter of about 5 μm were formed (volume: 95 $cm^3$).

<Second Step>

[Preparation of Adhesive Particles]

To this mixture, 60 g of dispersion (1) were slowly added as a resin-containing particulate dispersion. The volume of resin particles contained in the dispersion (1) was 25 $cm^3$. Then, the temperature of the heating oil bath was raised to 50° C. and kept for 1 hour.

<Third Step>

After that, 3 g of anionic surfactant (available from Dai-ichi Kogyo Seiyaku Co., Ltd.: NEOGEN SC) were added to the mixture and then the stainless flask was sealed. While using a magnetic seal, the mixture was stirred, heated to 105° C., and kept for 3 hours. Thereafter, it was cooled and then reaction products were filtered, well washed with ion-exchanged water, and dried to obtain a toner base. Then, 100 parts of the toner base particles, 1 part of hydrophobic silica and 1 part of hydrophobicized titanium oxide were mixed using a HENSCHEL MIXER to provide a toner. The properties of the toner are shown in Table 1, and evaluation results thereof are shown in Table 2.

Comparative Example 2

In a reaction vessel equipped with a condenser, stirrer, and nitrogen inlet tube, 724 parts of bisphenol A ethylene oxide dimolar adduct, 276 parts of terephthalic acid, and 2 parts of dibutyl tin oxide were placed, and the reaction was performed under normal pressure at 230° C. for 8 hours, and under a reduced pressure of 10–15 mmHg for 5 hours, then it was cooled to 160° C. and 32 parts of anhydrous phthalic acid was introduced into the reaction vessel, after which the reaction carried out for 2 hours.

Next, the mixture was cooled to 80° C. and reacted with 188 parts of isophorone diisocyanate in ethyl acetate for 2 hours to give isocyanate group-containing prepolymer (1). Then, 267 parts of the prepolymer (1) and 14 parts of isophorone diamine were reacted at 50° C. for 2 hours to obtain an urea-modified polyester having a weight average molecular weight of 64,000. In the same manner as above, 724 parts of bisphenol A ethylene oxide dimolar adduct, 138 parts of terephthalic acid, and 138 parts of isophthalic acid were polymerized under normal pressure at 230° C. for 6 hours, and under a reduced pressure of 10–15 mmHg for 5 hours, to obtain an unmodified polyester (a) having a peak molecular weight of 2,300, hydroxyl value of 55, and acid value of 1.

In 1000 parts of ethyl acetate/MEK (ratio: 1/1) mixture solvent, 200 parts of urea-modified polyester (1) and 800 parts of unmodified polyester (a) were dissolved and mixed to obtain an ethyl acetate/MEK solution of toner binder (1). To a reaction vessel having a condenser, stirrer, and thermometer, 942 parts of water, 58 parts of 10% suspension of hydroxyapatite (available from Nippon Chemical Industrial Co., Ltd.) were put and then stirred while 1000 parts of the ethyl acetate/MEK solution of toner binder (1) was added and dispersed. The temperature was raised to 98° C. to remove organic solvents and thereafter the dispersion was cooled. Next, it was filtered with water, washed, and dried. Thus, a toner binder (1) was obtained.

For the toner binder (1), Tg was 52° C., Tη was 123°, and TG' was 132° C.

By the following method, 100 parts of the toner binder (1), 7 parts of glycerin tribehenate, and 4 parts of cyanine blue KRO (available from Sanyo Color Works, Ltd.) were made into a toner.

First, a HENSCHEL MIXER (Mitsui Mining, FM10B) is used for preliminary mixing, and then the mixture was kneaded with a double axis kneader (Ikegai Ltd., PCM-30). Then, a supersonic jet pulverizer Labo Jet (Nippon Pneumatic Mfg. Co., Ltd.) is used to pulverize and thereafter an air flow classifier (Nippon Pneumatic, MDS-I) is used to classify and obtain toner base particles. Then, 100 parts of the toner base particles, 1 part of hydrophobic silica and 1 part of hydrophobicized titanium oxide were mixed using a HENSCHEL MIXER to provide a toner. The properties of the toner are shown in Table 1, and evaluation results thereof are shown in Table 2.

Comparative Example 3

(Manufacture Example of Prepolymer)

In a reaction vessel equipped with a condenser, stirrer, and nitrogen inlet tube, 724 parts of bisphenol A ethylene oxide dimolar adduct, 276 parts of terephthalic acid, and 2 parts of dibutyl tin oxide were placed, and the reaction was performed under normal pressure at 230° C. for 8 hours, and then it was reacted while being dehydrated under a reduced pressure of 10–15 mmHg for 5 hours, then it was cooled to 160° C. and 74 parts of anhydrous phthalic acid was introduced into the reaction vessel, after which the reaction carried out for 2 hours. Next, the mixture was cooled to 80° C. and reacted with 174 parts of ethylene glycol diglycidylether in toluene for 2 hours to give epoxy group-containing prepolymer (1) having weight average molecular weight of 13,000.

(Manufacture Example of Ketimine Compound)

Into a reaction vessel equipped with a stirrer and thermometer, 30 parts of isohorone diamine and 70 parts of methyl ethyl ketone were introduced, and the reaction was performed at 50° C. for 5 hours to obtain ketimine compound (1).

(Manufacture Example of Dead Polymer)

In the same manner as above, 654 parts of bisphenol A ethylene oxide dimolar adduct and 516 parts of dimethylterephthalate were polymerized under normal pressure at 230° C. for 6 hours, and under a reduced pressure of 10–15 mmHg while being dehydrated for 5 hours, to obtain a dead polymer having a peak molecular weight of 2,400 and hydroxyl value of 2.

(Manufacture Example of Toner)

In a beaker, 15.4 parts of the prepolymer (1) and 64 parts of the dead polymer (1) were stirred and dissolved in 78.6 parts of ethyl acetate. Next, 20 parts of pentaerythritol tetrabehenate and 4 parts of cyanine blue KRO (Sanyo Color Works) were added to the mixture, and the mixture was stirred at 60° C. using a TK homomixer at 12,000 rpm so that the mixture is uniformly dissolved and dispersed. Finally, 2.7 parts of ketimine compound (1) was added and dissolved. Thus a toner material solution (1) is obtained.

In a beaker of 706 parts of water, 294 parts of 10% suspension of hydroxyapatite (available from Nippon Chemical Industrial Co., Ltd., Supatite 10) and 0.2 parts of sodium dodecylbenzene sulfonate were added and uniformly dissolved. Then, the temperature of the mixture was raised to 60° C. and stirred using a TK homomixer at 12,000 rpm while the toner material solution (1) was added and kept stirred for 10 minutes. Thereafter, the mixture was transferred to a flask having a stirrer and thermometer, and heated to 98° C. Solvent was removed while the mixture was ureated, and then it was filtered, washed, dried, and thereafter classified by air flow to obtain toner base particles.

Then, 100 parts of the toner base particles, 1 part of hydrophobic silica and 1 part of hydrophobicized titanium oxide were mixed using a HENSCHEL MIXER to provide a toner. The toner binder component had a weight average molecular weight of 14,000, number average molecular weight of 2,000, and glass transition point (Tg) of 52° C. The properties of the toner are shown in Table 1, and evaluation results thereof are shown in Table 2.

TABLE 1

| | | Sphericity | | | Particle diameter | | |
|---|---|---|---|---|---|---|---|
| | | | | | Volume | Number | |
| | S/V ratio | Average sphericity E | Sphericity SF1 | Sphericity SF2 | mean diameter (Dv) | mean diameter (Dn) | Dv/Dn |
| Example 1 | 3.1 | 0.95 | 120 | 115 | 6.4 | 5.5 | 1.16 |
| Example 2 | 1.7 | 0.94 | 125 | 121 | 6.5 | 5.2 | 1.25 |
| Example 3 | 2.1 | 0.95 | 128 | 110 | 3.1 | 2.6 | 1.19 |
| Example 4 | 8.6 | 0.93 | 115 | 117 | 8.1 | 6.9 | 1.17 |
| Example 5 | 1.3 | 0.97 | 118 | 106 | 5.5 | 4.5 | 1.22 |
| Example 6 | 1.1 | 0.96 | 129 | 121 | 6.3 | 5.9 | 1.07 |
| Example 7 | 13 | 0.98 | 121 | 118 | 4.5 | 4.0 | 1.13 |
| Example 8 | 3.1 | 0.89 | 138 | 127 | 6.7 | 5.4 | 1.24 |
| Example 9 | 3.4 | 0.91 | 141 | 128 | 5.1 | 4.2 | 1.21 |
| Example 10 | 2.8 | 0.92 | 137 | 132 | 5.3 | 4.9 | 1.08 |
| Example 11 | 9.7 | 0.92 | 134 | 127 | 5.8 | 4.6 | 1.26 |
| Comparative example 1 | 0.0 | 0.91 | 122 | 129 | 6.6 | 5.6 | 1.18 |
| Comparative example 2 | 0.8 | 0.88 | 148 | 133 | 7.0 | 5.8 | 1.21 |
| Comparative example 3 | 0.7 | 0.94 | 120 | 125 | 3.3 | 2.8 | 1.18 |

TABLE 2

| | Fusing properties | | | | | | | | |
|---|---|---|---|---|---|---|---|---|---|
| | LFT (° C.) | HFT (° C.) | Cleanability | CS | ID | IGS | Fog | Toner scatter | EP |
| Example 1 | 140 | More than 210 | Good | Good | Good | Good | Good | Good | Good |
| Example 2 | 130 | 190 | Good | Good | Good | Good | Good | Good | Good |
| Example 3 | 130 | More than 210 | Fair | Good | Good | Very good | Fair | Fair | Good |
| Example 4 | 140 | More than 210 | Good | Good | Good | Fair | Very good | Very good | Very good |
| Example 5 | 125 | 190 | Fair | Good | Good | Very good | Good | Good | Fair |
| Example 6 | 125 | 150 | Fair | Good | Good | Good | Good | Fair | Fair |
| Example 7 | 145 | 190 | Good | Fair | Good | Fair | Very good | Good | Very good |
| Example 8 | 140 | More than 210 | Good | Fair | Good | Fair | Good | Good | Good |
| Example 9 | 135 | 200 | Fair | Good | Good | Fair | Good | Fair | Very good |
| Example 10 | 145 | 185 | Very good | Fair | Good | Fair | Fair | Fair | Very good |
| Example 11 | 155 | 195 | Fair | Good | Good | Fair | Fair | Fair | Fair |
| Comparative example 1 | 150 | 185 | Good | Poor | Poor | Fair | Poor | Poor | Poor |
| Comparative example 2 | 145 | 150 | Very good | Fair | Poor | Poor | Fair | Poor | Fair |
| Comparative example 3 | 145 | 150 | Good | Poor | Poor | Fair | Poor | Poor | Poor |

Note:
LFT = Lowest fusing temperature;
HFT = Highest fusing temperature;
CS = Charge stability;
ID = Image density;
IGS = Image graininess and sharpness; and
EP = Environmental preservability.

Examples 12 to 16

Five toners having different S/V ratio were prepared in order to understand the relationship of S/V ratio with hardness, heat resistance, and cross-linking density.

Figure 7:
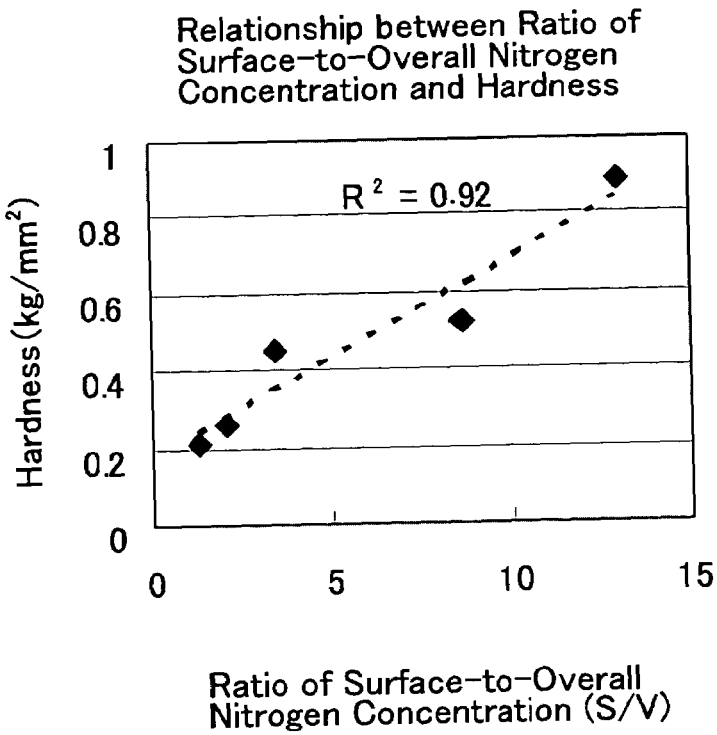
FIG. 7 is a graph showing a toner property relationship between the ratio of surface nitrogen concentration to overall nitrogen concentration and hardness.

Hardness was measured using a micro-compression tester MCT-W (200) available from Shimadzu Corporation. The tester has a compression rod of 50 μm diameter with a flat surface and a lower plate between which a specimen is placed and compressed. A toner particle was compressed while being observed with a microscope, and the strength at which the particle was crushed was measured. Test force was 0.1 gf and load rate was 0.00483 gf/sec. For each toner, 20 sample particles were taken and an average strength was derived. Results are plotted as shown in FIG. 7. It can be understood that hardness is proportional to S/V ratio.

Figure 8:
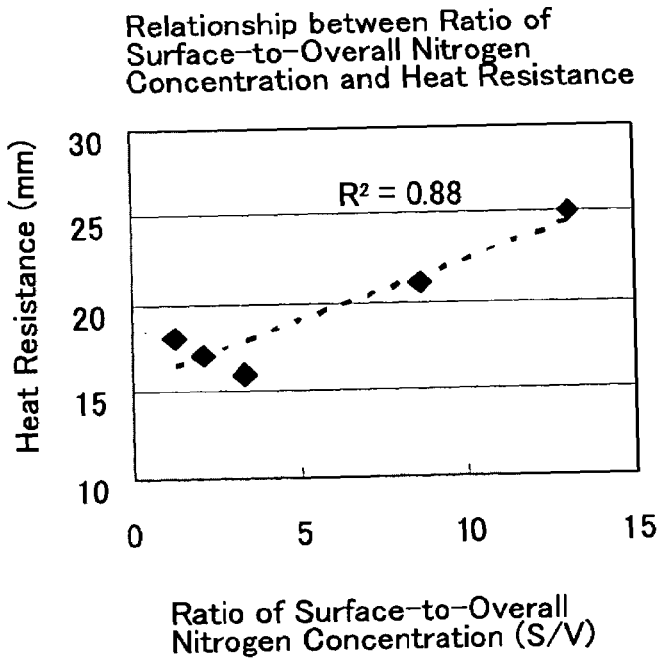
FIG. 8 is a graph showing a toner property relationship between the ratio of surface nitrogen concentration to overall nitrogen concentration and heat resistance.

Heat resistance was measured in the following manner. A sample of each toner was taken in an amount of 10 g and put in a 20 ml glass container. After the container was tapped for 100 times, it was set in a thermostat at a temperature of 55° C. and humidity of 80% for 24 hours. Then, penetration is measured using a penetrometer. In addition, penetration of the toner samples that were kept in a cold and dry environment (10° C., 15%) was also measured, and the lower value of penetration of the two conditions, hot and humid and cold and dry, was used for evaluation. Results are plotted as shown in FIG. 8. It can be understood that heat resistance is proportional to S/V ratio.

Figure 9:
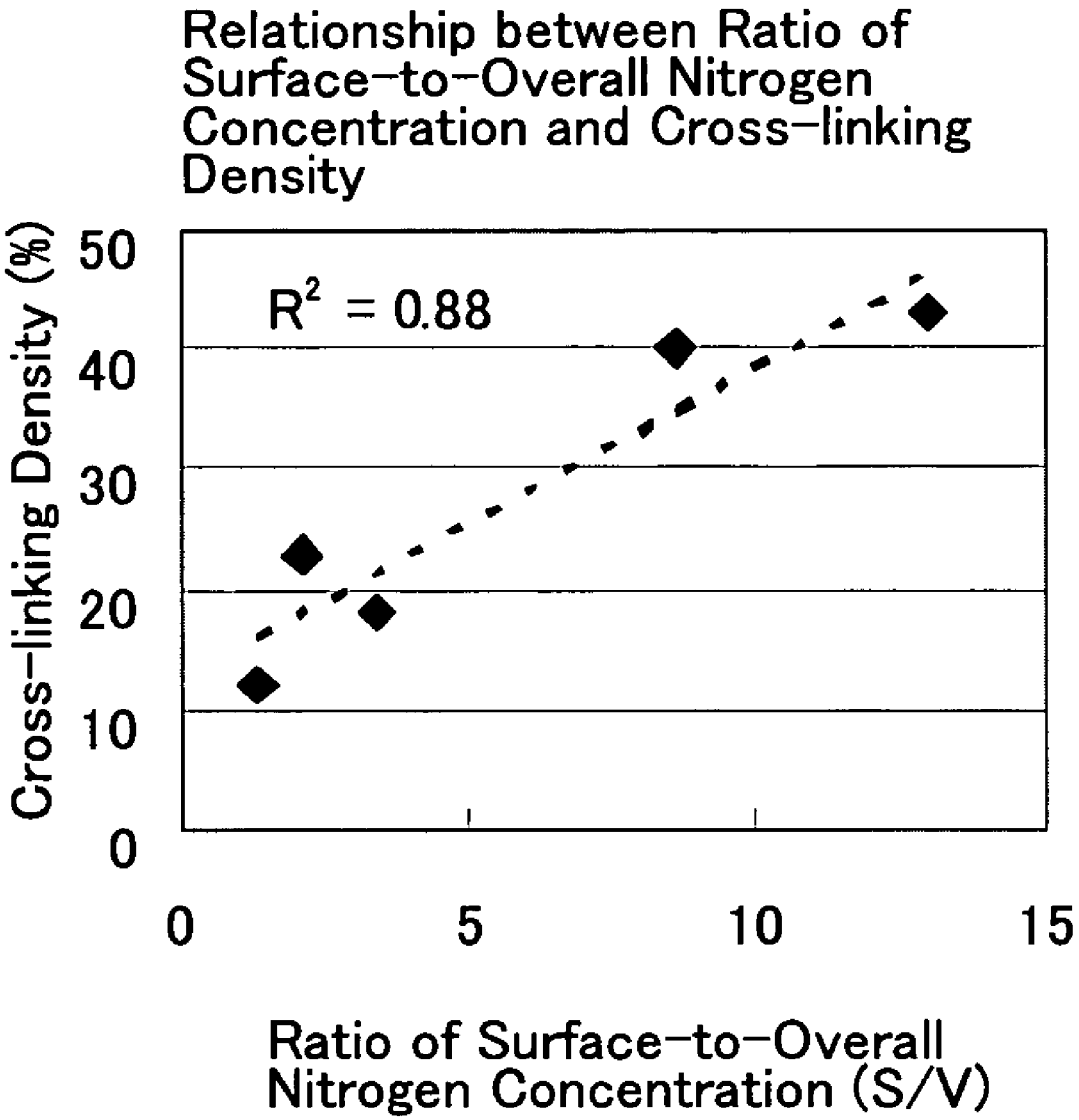
FIG. 9 is a graph showing a toner property relationship between the ratio of surface nitrogen concentration to overall nitrogen concentration and cross-linking density.

Cross-linking density was measured using gel fraction. For each toner, a predetermined amount thereof was dissolved in an excessive amount of dimethylformaldehyde (DMF). Then, the portion that did not dissolve was measured and gel ratio, which is the ratio of undissolved portion of toner to the entire toner, was calculated. Results are plotted as shown in FIG. 9. It can be understood that cross-linking density is proportional to S/V ratio.

Thus the present invention provides:

(1) A toner, a developer, an image forming apparatus, and a process for forming an image whose cleanability is maintained, that comply with low-temperature fusing systems, whose offset resistance is favorable, and that do not contaminate a fusing apparatus and an image;

(2) A toner, a developer, an image forming apparatus, and a process for forming an image in which the number of less charged and oppositely charged is small, whose distribution of charged amounts is narrow, and that can form visualized images having high sharpness for a long period of time;

(3) A toner, a developer, an image forming apparatus, and a process for forming an image whose environmental preservability (in hot and humid, or cold and dry environment) is excellent;

(4) An image forming apparatus and a process for forming an image that form images with little background shading (fog) having excellent charge stability in hot and humid or cold and dry environment, and in which toner does not spread out inside a machine; and (5) An image forming apparatus and a process for forming an image that are both highly durable and highly maintainable as an image forming system.

What is claimed is:

1. A toner for developing an electrostatic image, compnsing:

a polyester resin containing nitrogen; and a colorant, wherein a concentration of nitrogen at a surface of the toner is more than a concentration of nitrogen in the entire toner, and the surface of the toner is harder than a center portion of the toner;

wherein a ratio (S/V) of the surface concentration of nitrogen S to the overall concentration of nitrogen V is from 1.2 to 10.

2. A toner for developing an electrostatic image according to claim 1, a hardness of the polyester resin at the surface being higher than a hardness of the polyester resin at the center portion.

3. A toner for developing an electrostatic image, according to claim 1, wherein the surface of the toner is higher in heat resistance than the center portion of the toner.

4. A toner for developing an electrostatic image according to claim 3, a heat resistance of the polyester resin at the surface being higher than a heat resistance of the polyester resin at the center.

5. A toner for developing an electrostatic image, according to claim 1, wherein the surface of the toner is higher in cross-linking density than the center portion of the toner.

6. A toner for developing an electrostatic image according to claim 5, a cross-linking density of the polyester resin at the surface being higher than a cross-linking density of the polyester resin at the center.

7. A toner for developing an electrostatic image according to claim 1, the nitrogen-containing polyester resin being a polyester resin modified with urea bonds.

8. A toner for developing an electrostatic image according to claim 1, the toner comprising particles formed by elongation and/or cross-linking of a toner composition, the toner composition including a prepolymer being dissolved in oil droplets dispersed in an aqueous medium.

9. A toner for developing an electrostatic image according to claim 8, the toner particles being substantially spherical and an average sphericity E of the toner particles being from 0.90 to 0.99.

10. A toner for developing an electrostatic image according to claim 8, wherein said particles are obtained by reacting a dispersion of an organic solvent in which a prepolymer (A) having isocyanate groups is dissolved or dispersed with amines (B) in an aqueous phase, and allowing the reaction to mature after the reactants are mixed and the solvent is removed.

11. A toner for developing an electrostatic image according to claim 1, a sphericity SF-1 of the toner being from 100 to 140 and a sphericity SF-2 of the toner being from 100 to 130.

12. A toner for developing an electrostatic image according to claim 1, a volume mean diameter Dv of the toner particles being from 2 μm to 7 μm and a ratio (Dv/Dn) of the volume mean diameter Dv to a number mean diameter Dn being 1.25 or less.

13. A two component developer comprising:

a toner; and carrier particles containing magnetic particles, the toner comprising:

a polyester resin containing nitrogen; and a colorant, wherein a concentration of nitrogen at the surface is more than a concentration of nitrogen in the entire toner, and a portion at a surface of the toner is harder than a center portion of the toner;

wherein a ratio (S/V) of the surface concentration of nitrogen S to the overall concentration of nitrogen V is from 1.2 to 10.

14. An image forming apparatus comprising:

an electrostatic image carrier which supports an electrostatic image;

an image-developer for developing the electrostatic latent image into a toner image, which houses a developer therein; and a transfer which transfers the toner image to a support material, wherein the developer contains:

a toner; and carrier particles containing magnetic particles, the toner comprising:

a polyester resin containing nitrogen; and a colorant, wherein a concentration of nitrogen at the surface is more than a concentration of nitrogen in the entire toner, and a portion at a surface of the toner is harder than a center portion of the toner;

wherein a ratio (S/V) of the surface concentration of nitrogen S to the overall concentration of nitrogen V is from 1.2 to 10.

15. A process for forming an image comprising:

developing an electrostatic image by a developer containing:

a toner; and carrier particles containing magnetic particles, the toner comprising:

a polyester resin containing nitrogen; and a colorant, wherein a concentration of nitrogen at the surface is more than a concentration of nitrogen in the entire toner, and a portion at a surface of the toner is harder than a center portion of the toner;

wherein a ratio (S/V) of the surface concentration of nitrogen S to the overall concentration of nitrogen V is from 1.2 to 10.

16. A toner container comprising:

a toner containing:

a polyester resin containing nitrogen; and a colorant, wherein a concentration of nitrogen at the surface is more than a concentration of nitrogen in the entire toner, and a portion at a surface of the toner is harder than a center portion of the toner;

wherein a ratio (S/V) of the surface concentration of nitrogen S to the overall concentration of nitrogen V is from 1.2 to 10.

17. A process cartridge comprising:

an image-developer for developing an electrostatic latent image into a toner image, which houses a toner therein; and an electrostatic image substrate, wherein the toner contains:

a polyester resin containing nitrogen; and a colorant, wherein a concentration of nitrogen at the surface is more than a concentration of nitrogen in the entire toner, and a portion at a surface of the toner is harder than a center portion of the toner;

wherein a ratio (S/V) of the surface concentration of nitrogen S to the overall concentration of nitrogen V is from 1.2 to 10.

18. A toner for developing an electrostatic image, comprising:

a polyester resin containing nitrogen; and a colorant, wherein a concentration of nitrogen at a surface of the toner is more than a concentration of nitrogen in the entire toner, and the surface of the toner is higher in heat resistance than a center portion of the toner;

wherein a ratio (S/V) of the surface concentration of nitrogen S to the overall concentration of nitrogen V is from 1.2 to 10.

19. A toner for developing an electrostatic image, comprising:

a polyester resin containing nitrogen; and a colorant, wherein a concentration of nitrogen at a surface of the toner is more than a concentration of nitrogen in the entire toner, and the surface of the toner is higher in cross-linking density than a center portion of the toner;

wherein a ratio (S/V) of the surface concentration of nitrogen S to the overall concentration of nitrogen V is from 1.2 to 10.

* * * * *